US010464706B2

(12) United States Patent
Taruno

(10) Patent No.: US 10,464,706 B2
(45) Date of Patent: Nov. 5, 2019

(54) LAMINATION SEPARATION CONTAINER

(71) Applicant: KYORAKU CO., LTD., Kyoto (JP)

(72) Inventor: Shinsuke Taruno, Kanagawa (JP)

(73) Assignee: KYORAKU CO., LTD., Kyoto (JP)

( * ) Notice: Subject to any disclaimer, the term of this patent is extended or adjusted under 35 U.S.C. 154(b) by 151 days.

(21) Appl. No.: 15/527,882

(22) PCT Filed: Nov. 13, 2015

(86) PCT No.: PCT/JP2015/081997
§ 371 (c)(1),
(2) Date: May 18, 2017

(87) PCT Pub. No.: WO2016/080313
PCT Pub. Date: May 26, 2016

(65) Prior Publication Data

US 2018/0327130 A1 Nov. 15, 2018

(30) Foreign Application Priority Data

Nov. 19, 2014 (JP) ..... 2014-234323
Apr. 27, 2015 (JP) ..... 2015-090244

(51) Int. Cl.
*B65D 1/02* (2006.01)
*B65D 23/02* (2006.01)
*B65D 83/00* (2006.01)

(52) U.S. Cl.
CPC ..... *B65D 1/0215* (2013.01); *B65D 1/023* (2013.01); *B65D 1/0276* (2013.01); *B65D 23/02* (2013.01); *B65D 83/0055* (2013.01)

(58) Field of Classification Search
CPC .... B65D 1/0215; B65D 1/0207; B65D 1/023; B65D 1/0276; B65D 1/40; B65D 23/02;
(Continued)

(56) References Cited

U.S. PATENT DOCUMENTS 2,022,083 A * 11/1935 Geistlinger ..... A61J 9/04 215/11.5
2,061,397 A * 11/1936 Geistlinger ..... A61J 9/04 137/144

(Continued)

FOREIGN PATENT DOCUMENTS

CA 2482026 A1 3/2006
JP H04-267727 A 9/1992

(Continued)

OTHER PUBLICATIONS

European Extended Search Report dated Oct. 23, 2017 from corresponding European Patent Application No. 15861777.9; 12 pages.

(Continued)

*Primary Examiner* — Robert J Hicks
(74) *Attorney, Agent, or Firm* — Maier & Maier, PLLC

(57) ABSTRACT

A delaminated container excellent in productivity is provided. A delaminated container that includes: a container body having an outer shell and an inner bag, the inner bag delamination from the outer shell with a decrease in contents to be shrunk; and a valve member regulating entrance and exit of air between an external space of the container body and an intermediate space between the outer shell and the inner bag. The container body includes a storage portion to store the contents and a mouth to discharge the contents from the storage portion, the outer shell includes a fresh air inlet communicating the intermediate space with the external space in the storage portion, the valve member includes a tube having a cavity provided to communicate the external space with the intermediate space and a mobile part movably stored in the cavity.

10 Claims, 22 Drawing Sheets

(58) Field of Classification Search
CPC .... B65D 83/0055; B65D 25/14; B65D 25/16; B65D 25/18; A61J 9/005; A61J 9/001; A61J 9/00
USPC ..... 220/62.21, 62.11, 62.12, 495.06, 495.05, 220/495.04, 495.03, 667, 666, 203.24, 220/203.28, 203.22, 203.19, 203.01; 215/12.2, 12.1, 11.3, 11.1, 900
See application file for complete search history.

(56) References Cited

U.S. PATENT DOCUMENTS

| | | | | |
|---|---|---|---|---|
| 2,105,160 | A * | 1/1938 | Piqueres | B05B 9/047 138/30 |
| 2,564,163 | A * | 8/1951 | Leperre | B65D 77/06 141/114 |
| 2,861,714 | A * | 11/1958 | Glossop | B65D 7/045 206/522 |
| 3,592,365 | A * | 7/1971 | Schwartzman | B65D 47/2075 222/209 |
| 5,156,300 | A | 10/1992 | Spahni et al. | |
| 5,653,258 | A | 8/1997 | Schwarz | |
| 6,581,803 | B1 | 6/2003 | Yoshimoto et al. | |
| 2004/0011809 | A1 | 1/2004 | Yoshimoto et al. | |
| 2005/0040182 | A1 | 2/2005 | Suzuki | |
| 2006/0216105 | A1 | 9/2006 | Byun | |
| 2010/0002961 | A1 | 1/2010 | Armstrong | |
| 2014/0190992 | A1 | 7/2014 | Kuwagaki et al. | |

FOREIGN PATENT DOCUMENTS

| | | | |
|---|---|---|---|
| JP | H06-504748 | A | 6/1994 |
| JP | H09-124051 | A | 5/1997 |
| JP | H09-301443 | A | 11/1997 |
| JP | H10157751 | A | 6/1998 |
| JP | H11-325284 | A | 11/1999 |
| JP | 2001-058673 | A | 3/2001 |
| JP | 2001-146260 | A | 5/2001 |
| JP | 2002-039409 | A | 2/2002 |
| JP | 2003-321038 | A | 11/2003 |
| JP | 2004-149196 | A | 5/2004 |
| JP | 2006-263464 | A | 10/2006 |
| JP | 2010-274963 | A | 12/2010 |
| JP | 2013-035557 | A | 2/2013 |

OTHER PUBLICATIONS

Office Action dated Aug. 3, 2018 in corresponding Korean Application No. 10-2017-7014062; 12 pages including English-language translation.
International Search Report dated Feb. 16, 2016 from corresponding International Patent Application No. PCT/JP2015/081997; 4 pages.

* cited by examiner

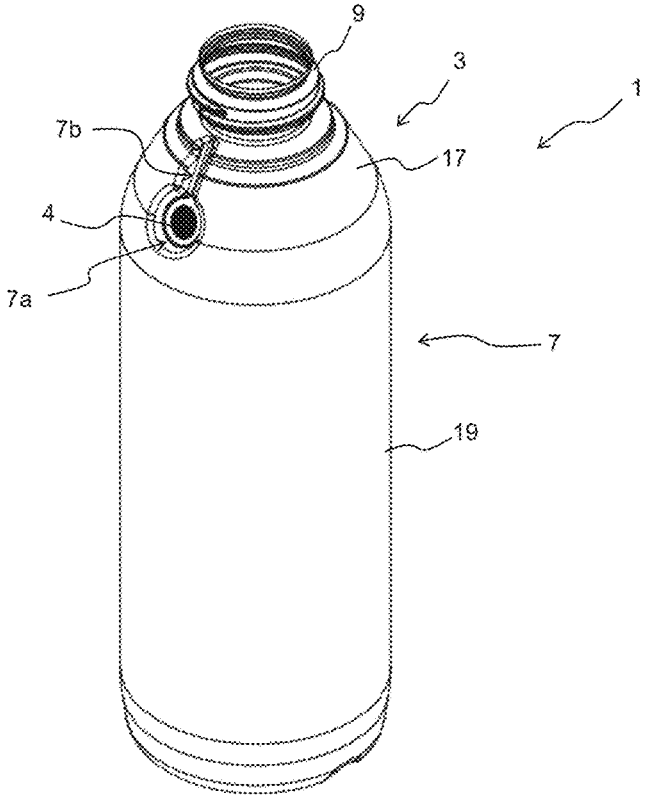
Fig. 1A
Fig. 1B
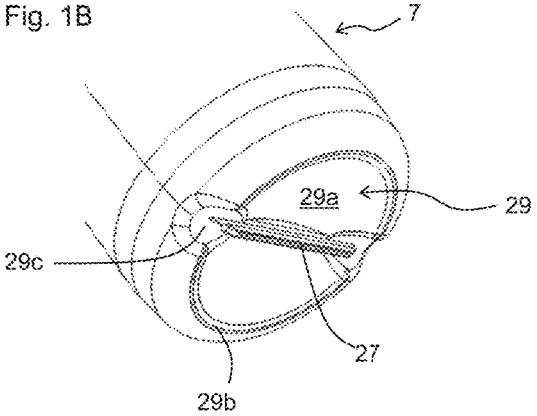
Fig. 1C
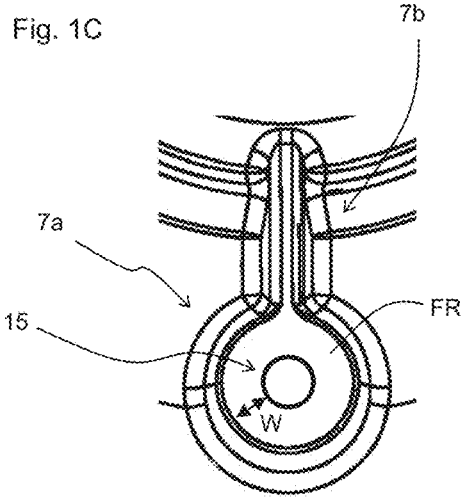

Fig. 8A
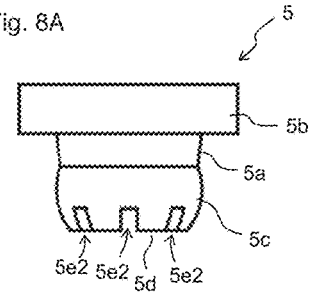
Fig. 8C
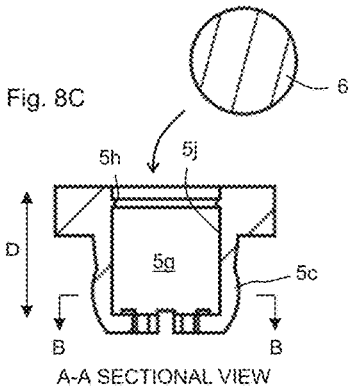
Fig. 8E
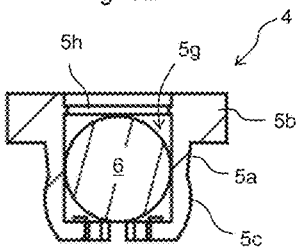
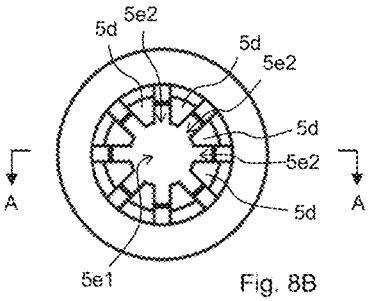
Fig. 8B
Fig. 8D
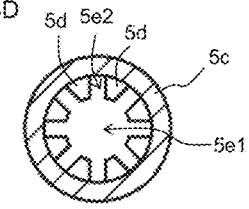
Fig. 8F
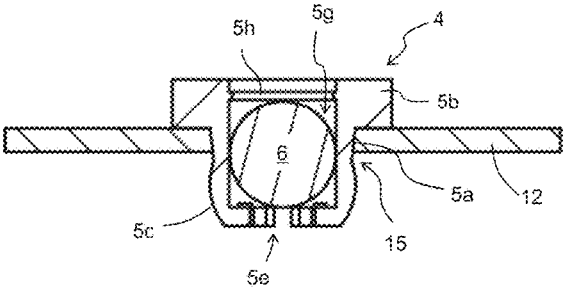
Fig. 8G
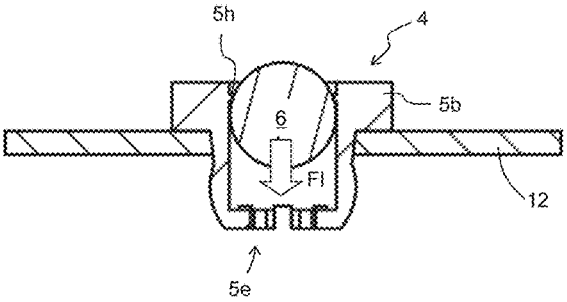

INNER BAG
EVOH
ADHESHION
PE
PP (OUTER SHELL)
MULTILAYER PARISON
DIE HEAD
MOLD
EXTRUDE PARISON

BLOW NOZZLE
CLOSE MOLD/BLOW

BLOW NOZZLE
LOWER BURR
OPEN MOLD

3
TAKE OUT/ARRANGE

SET CONTAINER

CUT WITH SUCTION

EMIT PIECE BY BLOW

PRELIMINARILY PEEL INNER LAYER

ENLARGED VIEW OF A REGION C

ENLARGED VIEW OF A REGION B

RELIEF PART HOT AIR BENDING STEP

CUT UPPER TUBULAR PART

RESTORE INNER PACKAGE BY BLOWING

CHARGE CONTENTS

CAPPING

SHRINK PACKAGING

WITHOUT INNER BAG SEPARATION

WITH INNER BAG SEPARATION

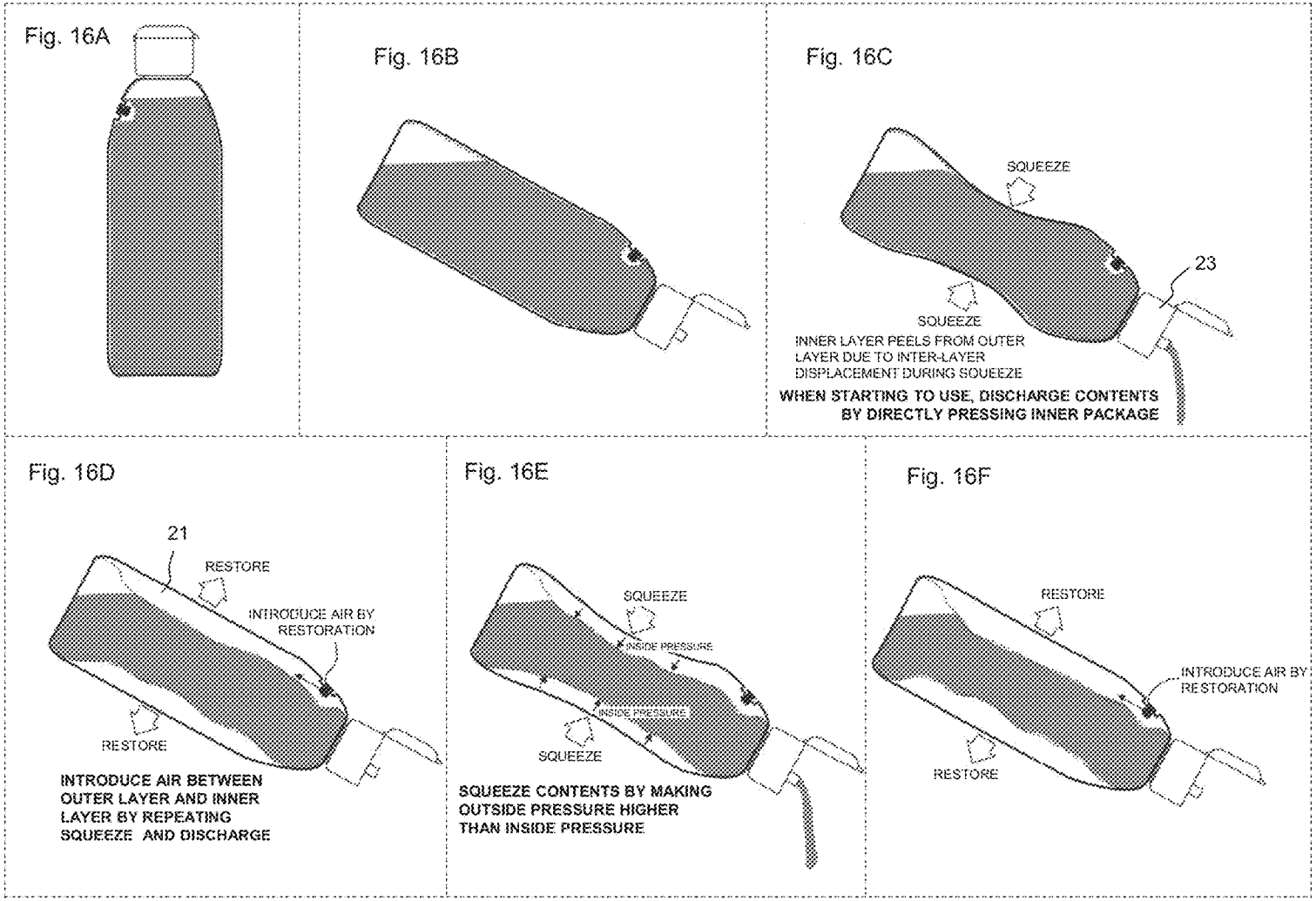
Fig. 16A
Fig. 16B
Fig. 16C
SQUEEZE
23
SQUEEZE
INNER LAYER PEELS FROM OUTER LAYER DUE TO INTER-LAYER DISPLACEMENT DURING SQUEEZE
WHEN STARTING TO USE, DISCHARGE CONTENTS BY DIRECTLY PRESSING INNER PACKAGE
Fig. 16D
21
RESTORE
INTRODUCE AIR BY RESTORATION
RESTORE
INTRODUCE AIR BETWEEN OUTER LAYER AND INNER LAYER BY REPEATING SQUEEZE AND DISCHARGE
Fig. 16E
SQUEEZE
INSIDE PRESSURE
INSIDE PRESSURE
SQUEEZE
SQUEEZE CONTENTS BY MAKING OUTSIDE PRESSURE HIGHER THAN INSIDE PRESSURE
Fig. 16F
RESTORE
INTRODUCE AIR BY RESTORATION
RESTORE

A-A SECTIONAL VIEW

B-B SECTIONAL VIEW

ENLARGED VIEW OF REGION U

Fig. 20A
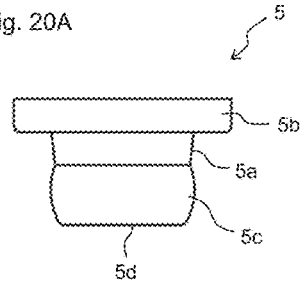
Fig. 20C A-A SECTIONAL VIEW
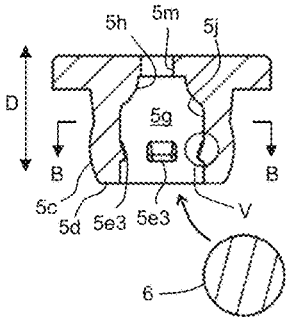
Fig. 20E
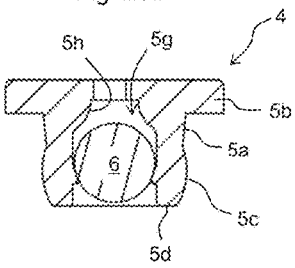
Fig. 20H
ENLARGED VIEW OF REGION V
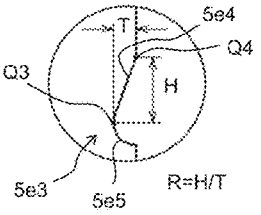
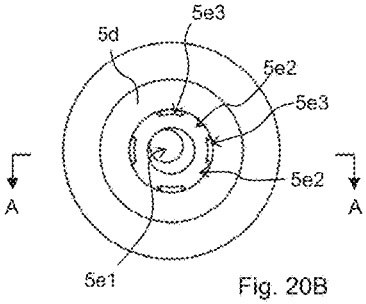
Fig. 20B
Fig. 20D
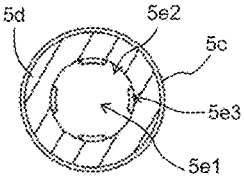
B-B SECTIONAL VIEW
Fig. 20F
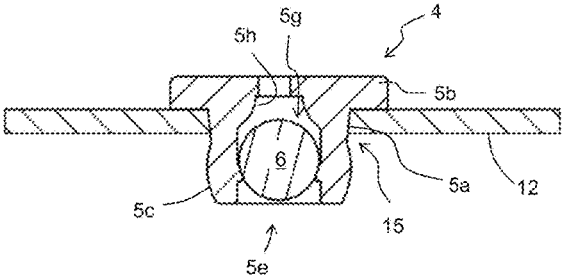
Fig. 20G
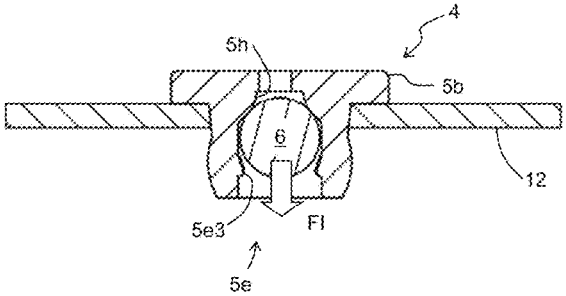

LAMINATION SEPARATION CONTAINER

TECHNICAL FIELD

The present invention relates to a delaminated container.

BACKGROUND ART

Delaminated containers are conventionally known that include a container body having an outer shell and an inner bag and having the inner bag delamination, with a decrease in contents, from the outer shell to be shrunk, and a check valve to regulate entrance and exit of air between an external space of the container body and an intermediate space between the outer shell and the inner bag (PTLs 1 and 2).

In PTL 1, a cap mounted to the mouth of the container body has a built-in valve.

In PTL 2, inside the main portion of the outer shell is equipped with a valve.

CITATION LIST

Patent Literature

PTL 1: JP 2013-35557A
PTL 2: JP 4-267727A

SUMMARY OF INVENTION

Technical Problem

In the configuration of PTL 1, a cap structure is complex, leading to an increase in production costs. In the configuration of PTL 2, a troublesome step of bonding a check valve to the inside of the main portion of the outer shell is required, leading to an increase in production costs.

The present invention has made in view of such circumstances to provide a delaminated container excellent in productivity.

Solution to Problem

According to the present invention, a delaminated container is provided that includes: a container body having an outer shell and an inner bag, the inner bag delamination from the outer shell with a decrease in contents to be shrunk; and a valve member regulating entrance and exit of air between an external space of the container body and an intermediate space between the outer shell and the inner bag, wherein the container body includes a storage portion to store the contents and a mouth to discharge the contents from the storage portion, the outer shell includes a fresh air inlet communicating the intermediate space with the external space in the storage portion, the valve member includes a tube having a cavity provided to communicate the external space with the intermediate space and a mobile part movably stored in the cavity, the tube includes a stem disposed in the fresh air inlet and a locking portion provided on an external space side in the stem and preventing entrance of the tube to the intermediate space, the stem has a tapered shape towards an intermediate space side and has an outer circumferential surface closely contacting to an edge of the fresh air inlet, thereby mounting the tube to the container body, the tube has a stopper to lock the mobile part, in movement of the mobile part from the intermediate space side towards the external space side, on a surface surrounding the cavity, and the stopper is configured to block air communication through the cavity when the mobile part abuts on the stopper.

The present inventor made an intensive review to allow mounting of a valve member to an outer shell by pressing the valve member into the fresh air inlet of the outer shell from outside the outer shell. According to such configuration, a cap is not required to be equipped with a check valve and the valve member may be readily mounted, allowing a simple structure and high productivity.

In addition, the valve member of the present invention is configured with a tube and a mobile part, both of which can be produced by injection molding with high accuracy. Accordingly, the mobile part is capable of smoothly moving in the tube, resulting in secure dropping even in a small amount. The delaminated container of the present invention is thus preferably used for delivery of a small amount of liquid, such as for an eye drop container.

Various embodiments of the present invention are described below as examples. The embodiments below may be combined with each other.

Preferably, the tube has an end providing a flat surface.

Preferably, the flat surface is provided with an opening in communication with the cavity, and the opening has radially extending slits.

Preferably, the tube has a diametrically expanded portion provided on the intermediate space side of the stem and preventing drawing of the tube from outside the container body.

Preferably, the diametrically expanded portion has a tapered shape towards the intermediate space side.

Preferably, the container further includes a cover covering, with the valve member mounted, surroundings of the valve member and the fresh air inlet to prevent introduction of fresh air into the intermediate space.

Preferably, the cover is a sealing member adhered to the surroundings of the valve member and the fresh air inlet.

Preferably, the cover is a cap mounted to the mouth of the container body.

Preferably, the valve member is configured to allow the mobile part to be inserted into the cavity from an opening on an intermediate space side of the cavity.

According to another aspect of the present invention, a delaminated container is provided that includes: a container body having an outer shell and an inner bag, the inner bag delamination from the outer shell with a decrease in contents to be shrunk; and a valve member to regulate entrance and exit of air between an external space of the container body and an intermediate space between the outer shell and the inner bag, wherein the container body includes a storage portion to store the contents and a mouth to discharge the contents from the storage portion, the outer shell includes a fresh air inlet communicating the intermediate space with the external space in the storage portion, the valve member is mounted to the fresh air inlet, and the container further includes, with the valve member mounted thereto, a cover covering surroundings of the valve member and the fresh air inlet to prevent introduction of fresh air into the intermediate space.

BRIEF DESCRIPTION OF DRAWINGS

FIGS. 1A-1C are perspective views illustrating a structure of a delaminated container 1 in a first embodiment of the present invention, where FIG. 1A illustrates an overall view, FIG. 1B illustrates the bottom, and FIG. 1C illustrates an enlarged view of and around a valve member mounting recess 7*a*. FIG. 1C illustrates a state of removing a valve member 4.

FIG. 2A is a front view, FIG. 2B is a rear view, FIG. 2C is a plan view, and FIG. 2D is a bottom view.

FIG. 3 illustrates a state after bending the bottom seal protrusion 27.

FIG. 6A illustrates a state before bending the bottom seal protrusion 27 and FIG. 6B illustrates.

FIG. 8A is a front view of a tube 5, FIG. 8B is a bottom view of the tube 5, FIG. 8C is an A-A cross-sectional view, FIG. 8D is a B-B cross-sectional view, FIG. 8E is a cross-sectional view of the valve member 4, FIG. 8F is a cross-sectional view illustrating a state of mounting the valve member 4 to an outer shell 12, and FIG. 8G is a cross-sectional view illustrating a state where a mobile part 6 abuts on a stopper 5*h* to close a cavity 5*g*.

FIG. 11A is a front view, FIG. 11B is a left side view, FIG. 11C is an A-A cross-sectional view, FIG. 11D is an enlarged view of a region B, and FIG. 11E is an enlarged view of a region C.

FIG. 12A is a front view and FIG. 12B is a left side view.

FIGS. 14A-14B illustrate a case of performing the air blowing preliminary delamination and FIGS. 14C-14D illustrate a case of not performing the air blowing preliminary delamination.

FIGS. 15A-15B illustrate a case of performing the inner bag separation and FIGS. 15C-15D illustrate a case of not performing the inner bag separation.

FIGS. 16A-16F illustrate a method of using the delaminated container 1 in FIGS. 1A-1C.

FIGS. 19A-19E are drawings corresponding to FIGS. 8A-8E and FIG. 19F is an enlarged view illustrating a stopper 5*h* of a tube 5 in the valve member 4.

FIGS. 20A-20H illustrate a valve member 4 in a third embodiment of the present invention, where FIG. 20A-20G are drawings corresponding to FIGS. 8A-8G and FIG. 20H is an enlarged cross-sectional view illustrating a projection 5*e*3 of a tube 5 in the valve member 4.

DESCRIPTION OF EMBODIMENTS

Figure 2C:
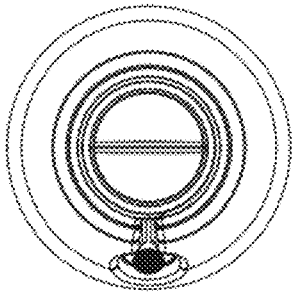
FIGS. 2A-2D illustrate the delaminated container 1 in FIGS. 1A-1C, where
Figure 2A:
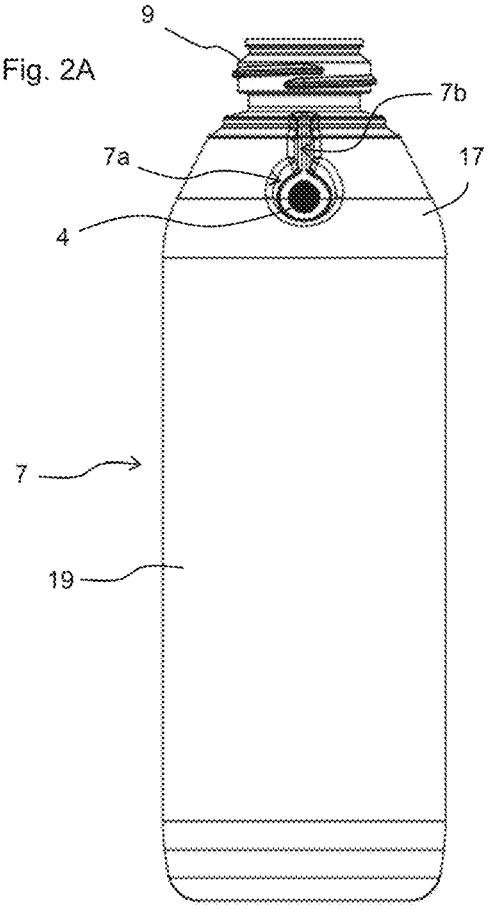
Figure 2B:
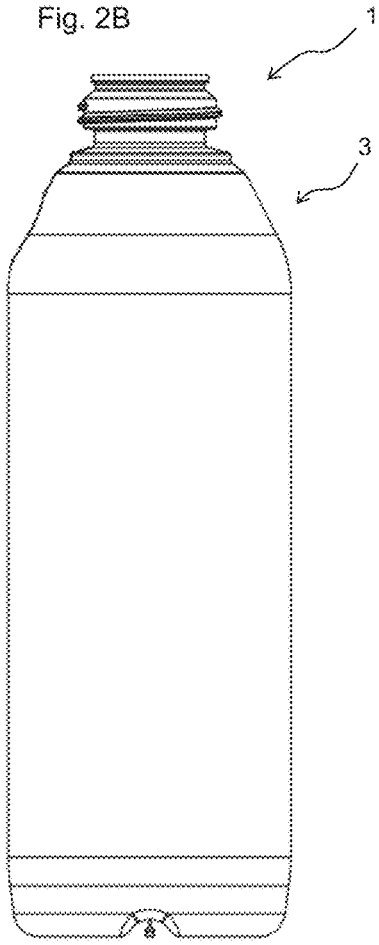
Figure 2D:
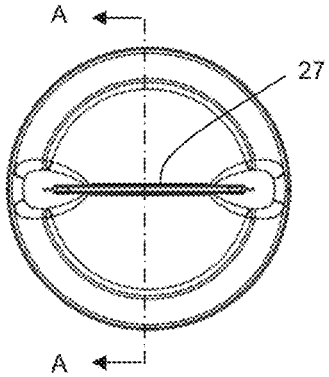

Embodiments of the present invention are described below. Various characteristics in the embodiments described below may be combined with each other. Each characteristic is independently inventive.

1. First Embodiment

As illustrated in FIGS. 1A through 2D, a delaminated container 1 in the first embodiment of the present invention is provided with a container body 3 and a valve member 4. The container body 3 is provided with a storage portion 7 to store the contents and a mouth 9 to deliver the contents from the storage portion 7.

Figure 3:
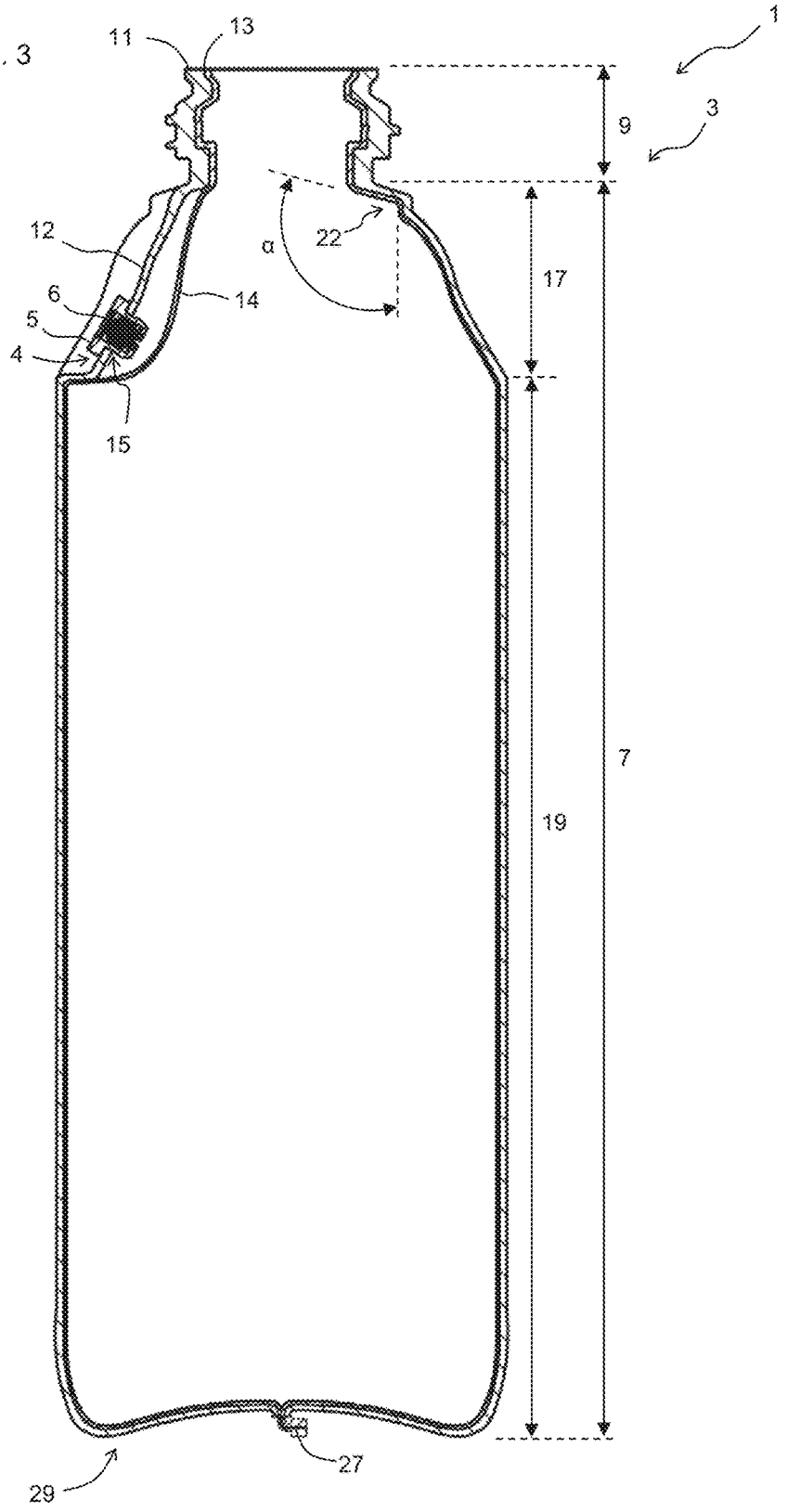
FIG. 3 is an A-A cross-sectional view in FIG. 2D. Note that FIGS. 1A through 2D illustrate states before bending a bottom seal protrusion 27

As illustrated in FIG. 3, the container body 3 is provided with an outer layer 11 and an inner layer 13 in the storage portion 7 and the mouth 9. An outer shell 12 is composed of the outer layer 11 and an inner bag 14 is composed of the inner layer 13. Due to delamination of the inner layer 13 from the outer layer 11 with a decrease in the contents, the inner bag 14 delaminates from the outer shell 12 to be shrunk.

Figure 4:
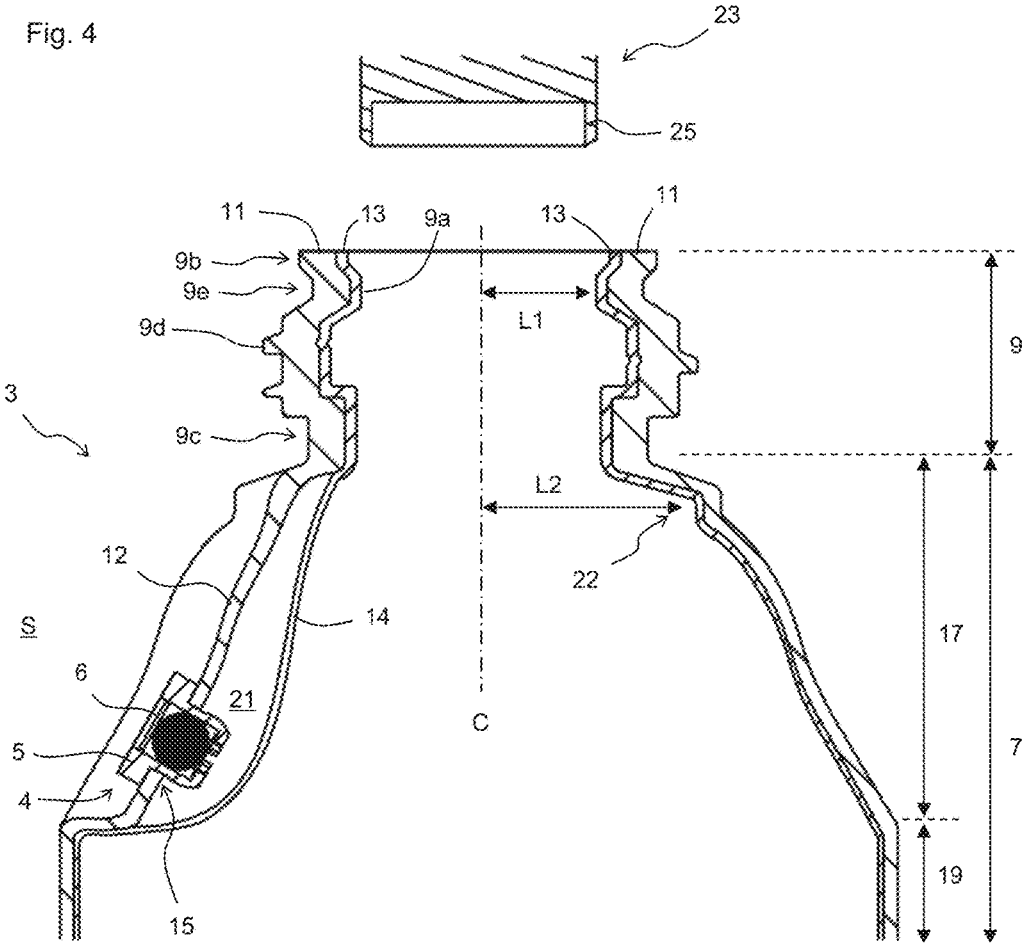
FIG. 4 is an enlarged view of a region including a mouth 9 in FIG. 3.

As illustrated in FIG. 4, the mouth 9 is equipped with external threads 9*d*. To the external threads 9*d*, a cap, a pump, or the like having internal threads is mounted. FIG. 4 partially illustrates a cap 23 having an inner ring 25. The inner ring 25 has an outer diameter approximately same as an inner diameter of the mouth 9. An outer surface of the inner ring 25 abuts on an abutment surface 9*a* of the mouth 9, thereby preventing leakage of the contents. In the present embodiment, the mouth 9 is equipped with an enlarged diameter portion 9*b* at the end. The enlarged diameter portion 9*b* has an inner diameter greater than the inner diameter in an abutment portion 9*e*, and thus the outer surface of the inner ring 25 does not make contact with the enlarged diameter portion 9*b*. When the mouth 9 does not have the enlarged diameter portion 9*b*, a defect sometimes occurs in which the inner ring 25 enters between the outer layer 11 and the inner layer 13 in the case where the mouth 9 has an even slightly smaller inner diameter due to variations in manufacturing. In contrast, when the mouth 9 has the enlarged diameter portion 9*b*, such defect does not occur even in the case where the mouth 9 has a slightly varied inner diameter.

The mouth 9 is also provided with an inner layer support portion 9*c* to inhibit slip down of the inner layer 13 in a position closer to the storage portion 7 than the abutment portion 9*e*. The inner layer support portion 9*c* is formed by providing a narrow part in the mouth 9. Even when the mouth 9 is equipped with the enlarged diameter portion 9*b*, the inner layer 13 sometimes delaminates from the outer layer 11 due to friction between the inner ring 25 and the inner layer 13. In the present embodiment, even in such case, the inner layer support portion 9*c* inhibits slip down of the inner layer 13, and thus it is possible to inhibit falling out of the inner bag 14 in the outer shell 12.

Figure 5:
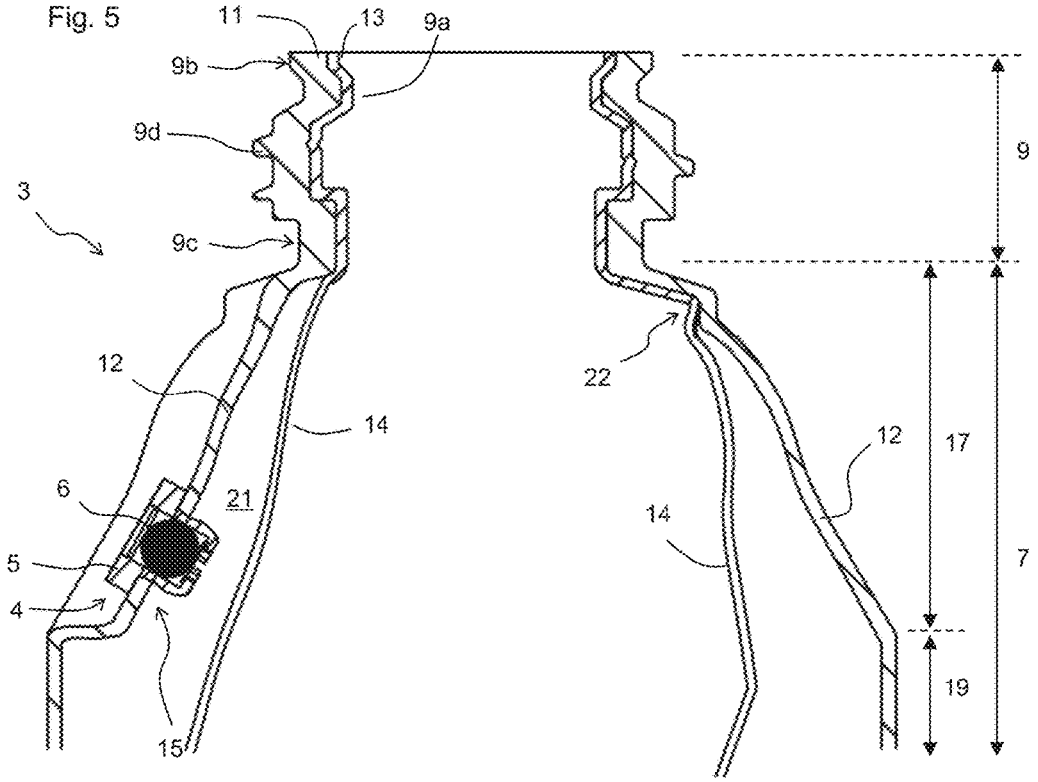
FIG. 5 illustrates a state where delamination of an inner bag 14 proceeds from the state in FIG. 4.

As illustrated in FIGS. 3 through 5, the storage portion 7 is provided with a main portion 19 having an approximately constant cross-sectional shape in longitudinal directions of the storage portion and a shoulder portion 17 linking the main portion 19 to the mouth 9. The shoulder portion 17 is equipped with a bent portion 22. The bent portion 22 is an area with a bending angle α illustrated in FIG. 3 of 140 degrees or less and having a radius of curvature on a container inner surface side of 4 mm or less. Without the bent portion 22, the delamination between the inner layer 13 and the outer layer 11 sometimes extends from the main portion 19 to the mouth 9 to delaminate the inner layer 13 from the outer layer 11 even in the mouth 9. The delamination of the inner layer 13 from the outer layer 11 in the mouth 9 is, however, undesirable because the delamination of the inner layer 13 from the outer layer 11 in the mouth 9 causes falling out of the inner bag 14 in the outer shell 12. Since the bent portion 22 is provided in the present embodiment, even when delamination between the inner layer 13 and the outer layer 11 extends from the main portion 19 to the bent portion 22, the inner layer 13 is bent at the bent portion 22 as illustrated in FIG. 5 and the force to delaminate the inner layer 13 from the outer layer 11 is not transmitted to the area above the bent portion 22. As a result, the delamination between the inner layer 13 and the outer layer 11 in the area above the bent portion 22 is inhibited. Although, in FIGS. 3 through 5, the bent portion 22 is provided in the shoulder portion 17, the bent portion 22 may be provided at the boundary between the shoulder portion 17 and the main portion 19.

Although the lower limit of bending angle α is not particularly defined, it is preferably 90 degrees or more for ease of manufacture. Although the lower limit of the radius of curvature is not particularly defined, it is preferably 0.2 mm or more for ease of manufacture. In order to prevent delamination of the inner layer 13 from the outer layer 11 in the mouth 9 more securely, the bending angle α is preferably 120 degrees or less and the radius of curvature is preferably 2 mm or less. Specifically, the bending angle α is, for example, 90, 95, 100, 105, 110, 115, 120, 125, 130, 135, and 140 degrees or it may be in a range between any two values exemplified here. Specifically, the radius of curvature is, for example, 0.2, 0.4, 0.6, 0.8, 1, 1.2, 1.4, 1.6, 1.8, and 2 mm or it may be in a range between any two values exemplified here.

As illustrated in FIG. 4, the bent portion 22 is provided in a position where a distance L2 from a container center axis C to the container inner surface in the bent portion 22 is 1.3 times or more of a distance L1 from the container center axis C to the container inner surface in the mouth 9. The delaminated container 1 in the present embodiment is formed by blow molding. The larger L2/L1 causes a larger blow ratio in the bent portion 22, which results in a thinner thickness. When L2/L1≥1.3, the thickness of the inner layer 13 in the bent portion 22 thus becomes sufficiently thin and the inner layer 13 is easily bent at the bent portion 22 to more securely inhibit delamination of the inner layer 13 from the outer layer 11 in the mouth 9. L2/L1 is, for example, from 1.3 to 3 and preferably from 1.4 to 2. Specifically, L2/L1 is, for example, 1.3, 1.4, 1.5, 1.6, 1.7, 1.8, 1.9, 2, 2.5, and 3 or it may be in a range between any two values exemplified here.

To give an example, the thickness in the mouth 9 is from 0.45 to 0.50 mm, the thickness in the bent portion 22 is from 0.25 to 0.30 mm, and the thickness of the main portion 19 is from 0.15 to 0.20 mm. The thickness in the bent portion 22 is thus sufficiently less than the thickness in the mouth 9, thereby effectively exhibiting functions of the bent portion 22.

As illustrated in FIG. 4, the storage portion 7 is equipped with the valve member 4 to regulate entrance and exit of air between an external space S of the container body 3 and an intermediate space 21 between the outer shell 12 and the inner bag 14. The outer shell 12 is equipped with a fresh air inlet 15 communicating with the intermediate space 21 and the external space S in the storage portion 7. The fresh air inlet 15 is a through hole provided only in the outer shell 12 and does not reach the inner bag 14. As illustrated in FIGS. 4 and 8A-8G, the valve member 4 is provided with a tube 5 having a cavity 5*g* provided to communicate the external space S with the intermediate space 21 and a mobile part 6 movably stored in the cavity 5*g*. The tube 5 and the mobile part 6 are formed by injection molding or the like, and the mobile part 6 is disposed in the cavity 5*g* by pressing the mobile part 6 into the cavity 5*g* to pass across a stopper 5*h* described later. In the present embodiment, the cavity 5*g* has an approximately cylindrical shape and the mobile part 6 has an approximately spherical shape while they may have another shape as long as the shape is capable of achieving same functions as those in the present embodiment. The cavity 5*g* has a diameter in a horizontal cross section (cross section in FIG. 8D) slightly larger than the corresponding diameter of the mobile part 6 and has a shape allowing the mobile part 6 to freely move in arrow D directions in FIG. 8C. A value of the ratio defined by the diameter of the cavity 5*g* in the horizontal cross section/the corresponding diameter of the mobile part 6 is preferably from 1.01 to 1.2 and more preferably from 1.05 to 1.15. This is because a too small value of the ratio causes interference with smooth movement of the mobile part 6 and a too large value of this ratio causes an excessive increase in the gap between the mobile part 6 and a surface 5*j* surrounding the cavity 5*g* and thus an insufficient force tends to be applied to the mobile part 6 for compression of the container body 3.

The tube 5 has a stem 5*a* disposed in the fresh air inlet 15, a locking portion 5*b* provided on the external space S side of the stem 5*a* and preventing entrance of the tube 5 to the intermediate space 21, and a diametrically expanded portion 5*c* provided on the intermediate space 21 side of the stem 5*a* and preventing drawing of the tube 5 from outside the container body 3. The stem 5*a* has a tapered shape towards the intermediate space 21 side. That is, the stem 5*a* has an outer circumferential surface providing a tapered surface. The outer circumferential surface of the stem 5*a* closely contacts with an edge of the fresh air inlet 15 to mount the tube 5 to the container body 3. Such configuration allows reduction in the gap between the tube 5 and the edge of the fresh air inlet 15. As a result, when the container body 3 is compressed, it is possible to inhibit leakage of the air in the intermediate space 21 from the gap between the tube 5 and the edge of the fresh air inlet 15. The tube 5 is mounted to the container body 3 by making the outer circumferential surface of the stem 5*a* close contact with the edge of the fresh air inlet 15, and the diametrically expanded portion 5*c* is thus not essential.

The surface 5*j* surrounding the cavity 5*g* is provided with a stopper 5*h* to lock the mobile part 6 in movement of the mobile part 6 from the intermediate space 21 side towards the external space S side. The stopper 5*h* is configured with an annular projection, and when the mobile part 6 abuts on the stopper 5*h*, to blocks air communication through the cavity 5*g*.

The tube 5 has an end providing a flat surface 5*d*, and the flat surface 5*d* is provided with an opening 5*e* in communication with the cavity 5*g*. The opening 5*e* has an approximately circular central opening 5*e*1 provided at the center of the flat surface 5*d* and a plurality of slits 5*e*2 radially extending from the central opening 5*e*1. Such configuration does not interfere with air flow even when the mobile part 6 abuts on the bottom of the cavity 5*g*.

As illustrated in FIG. 8F, when the valve member 4 is inserted into the fresh air inlet 15 from the diametrically expanded portion 5*c* side and the locking portion 5*b* is pressed into a position to abut on an outer surface of the outer shell 12, the outer circumferential surface of the stem 5*a* is held in the outer shell 12 in close contact with the edge of the fresh air inlet 15. When the outer shell 12 is compressed while air is in the intermediate space 21, the air in the intermediate space 21 enters into the cavity 5*g* through the opening 5*e* and causes the mobile part 6 to be lifted and abut on the stopper 5*h*. When the mobile part 6 abuts on the stopper 5*h*, the air flow through the cavity 5*g* is blocked.

When the outer shell 12 is further compressed in this state, the pressure in the intermediate space 21 is increased, and as a result, the inner bag is compressed to deliver the contents in the inner bag 14. When the compressive force to the outer shell 12 is released, the outer shell 12 attempts to restore its shape by the elasticity of its own. The pressure in the intermediate space 21 is reduced with the restoration of the outer shell 12, and as illustrated in FIG. 8G, a force FI in direction inside the container is applied to the mobile part 6. This causes the mobile part 6 to move towards the bottom of the cavity 5*g* to the state illustrated in FIG. 8F. Fresh air is thus introduced in the intermediate space 21 through the gap between the mobile part 6 and the surface 5*j*, and through the opening 5*e*.

The valve member 4 is allowed to be mounted to the container body 3 by inserting the diametrically expanded portion 5*c* into the intermediate space 21 while pressing and expanding the fresh air inlet 15 by the diametrically expanded portion 5*c*. The diametrically expanded portion 5*c* thus has an end preferably in a tapered shape. Being mounted only by pressing the diametrically expanded portion 5*c* into the intermediate space 21 from outside the container body 3, such valve member 4 is excellent in productivity. Since the tube 5 has an end provided with the flat surface 5*d*, the inner bag 14 is not easily damaged even when the valve member 4 is pressed into the intermediate space 21 and the end of the valve member 4 collides with the inner bag 14.

After the valve member 4 is mounted, the storage portion 7 is covered with a shrink film. At this point, not to allow the valve member 4 to interfere with the shrink film, the valve member 4 is mounted to a valve member mounting recess 7*a* provided in the storage portion 7. Not to seal the valve member mounting recess 7*a* with the shrink film, an air circulation groove 7*b* extending from the valve member mounting recess 7*a* in the direction of the mouth 9 is provided.

The container may be configured to provide a cover preventing introduction of fresh air into the intermediate space 21 by covering the surroundings of the valve member 4 and the fresh air inlet 15 with the valve member 4 mounted thereto. Such configuration prevents entrance of an odorous gas in a factory into the intermediate space 21 during production. For example, after the inner bag 14 is filled with the contents, the cover may be mounted in a clean atmosphere. While the valve member 4 and the fresh air inlet 15 are covered with the cover, fresh air is not introduced in the intermediate space 21 and the outer shell 12 does not restore its shape after compression. Users are thus supposed to use the container in a state of removing the cover.

Figure 17:
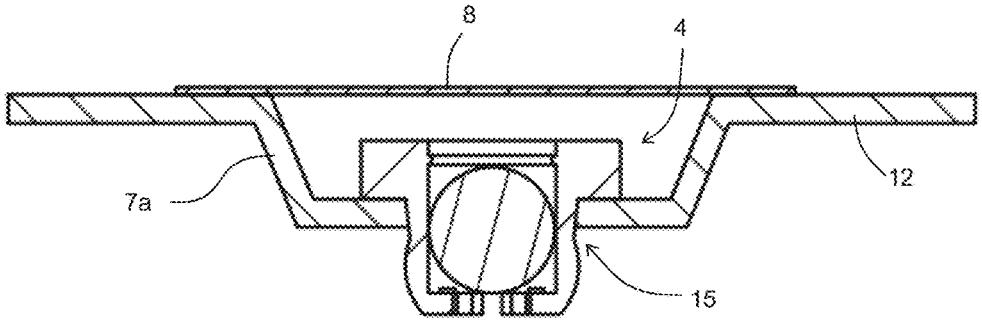
FIG. 17 is a cross-sectional view illustrating an example of using a sealing member as a cover.
Figure 18:
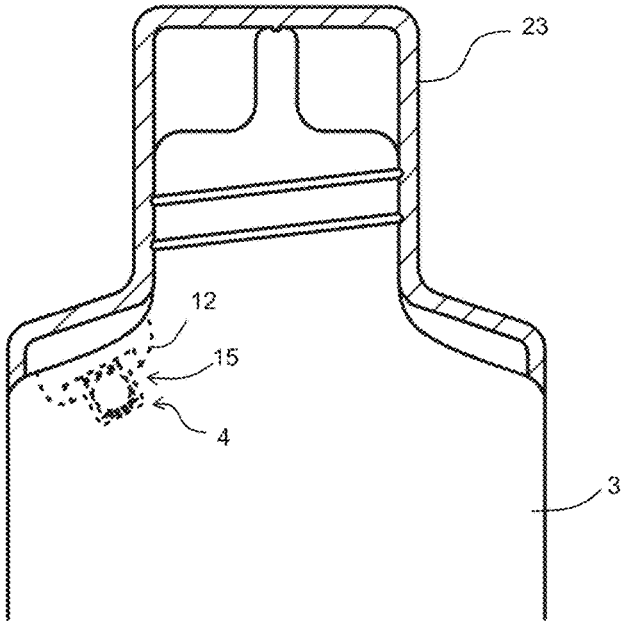
FIG. 18 is a front view illustrating an example of using a cap 23 as the cover.

Specific configuration examples include an example as illustrated in FIG. 17 of providing a sealing member 8 adhered to the surroundings of the valve member 4 and the fresh air inlet 15 (more specifically, the surroundings of the valve member mounting recess 7*a*) without providing the air circulation groove 7*b*. In this case, the sealing member 8 serves as the cover. Another configuration example includes an example of, as illustrated in FIG. 18, covering the surroundings of the valve member 4 and the fresh air inlet 15 with the cap 23. In this case, the cap 23 serves as the cover.

The technique of preventing entrance of an odorous gas into the intermediate space 21 using a cover is applicable to a valve member in configuration other than the valve member 4 to open and close the fresh air inlet 15 by movement of the mobile part 6 as in the present embodiment. Examples of the valve member in other configuration include a valve member in configuration of opening and closing the gap between the valve member 4 and the edge of the fresh air inlet 15 by movement of the valve member.

The valve member mounting recess 7*a* is provided in the shoulder portion 17 of the outer shell 12. The shoulder portion 17 is an inclined surface, and a flat region FR is provided in the valve member mounting recess 7*a*. Since the flat region FR is provided approximately in parallel with the inclined surface of the shoulder portion 17, the flat region FR is also an inclined surface. Since the fresh air inlet 15 is provided in the flat region FR in the valve member mounting recess 7*a*, the fresh air inlet 15 is provided in the inclined surface. When the fresh air inlet 15 is provided in, for example, a vertical surface of the main portion 19, there is a risk that the once delaminated inner bag 14 makes contact with the valve member 4 to interfere with movement of the valve member 4. In the present embodiment, since the fresh air inlet 15 is provided in the inclined surface, there is no such risk and smooth movement of the valve member 4 is secured. Although not particularly limited, an inclination angle of the inclined surface is preferably from 45 to 89 degrees, more preferably from 55 to 85 degrees, and even more preferably from 60 to 80 degrees.

As illustrated in FIG. 1C, the flat region FR in the valve member mounting recess 7*a* is provided across a width W of 3 mm or more (preferably 3.5 mm, 4 mm, or more) surrounding the fresh air inlet 15. For example, when the fresh air inlet 15 is ϕ 4 mm and the fresh air inlet 15 is formed at the center of the flat region FR, the valve member mounting recess 7*a* is designed to be ϕ 10 mm or more. Although the upper limit of the width W of the flat region FR is not particularly defined, the width W is preferably not too large because a larger width W of the flat region FR causes the valve member mounting recess 7*a* to have a greater area, and as a result, the area of the gap between the outer shell 12 and the shrink film. The upper limit is, for example, 10 mm. Accordingly, the width W is, for example, from 3 to 10 mm.

Specifically, it is, for example, 3, 3.5, 4, 4.5, 5, 6, 7, 8, 9, and 10 mm or it may be in a range between any two values exemplified here.

According to an experiment by the present inventors, it is found that a wider flat region FR on an outer surface side of the outer shell 12 causes a larger radius of curvature on an inner surface of the outer shell 12, and when the flat region FR is provided across the range of 3 mm or more surrounding the fresh air inlet 15 on the outer surface side of the outer shell, the radius of curvature on the inner surface of the outer shell 12 is sufficiently large, and as a result, the close contact between the outer shell 12 and the valve member 4 is improved. The radius of curvature on the inner surface of the outer shell 12 is preferably 200 mm or more in a range of 2 mm surrounding the fresh air inlet 15 and even more preferably 250 mm or more or 300 mm or more. This is because, when the radius of curvature has such value, the inner surface of the outer shell 12 substantially becomes flat and the close contact between the outer shell 12 and the valve member 4 is good.

Figure 6A:
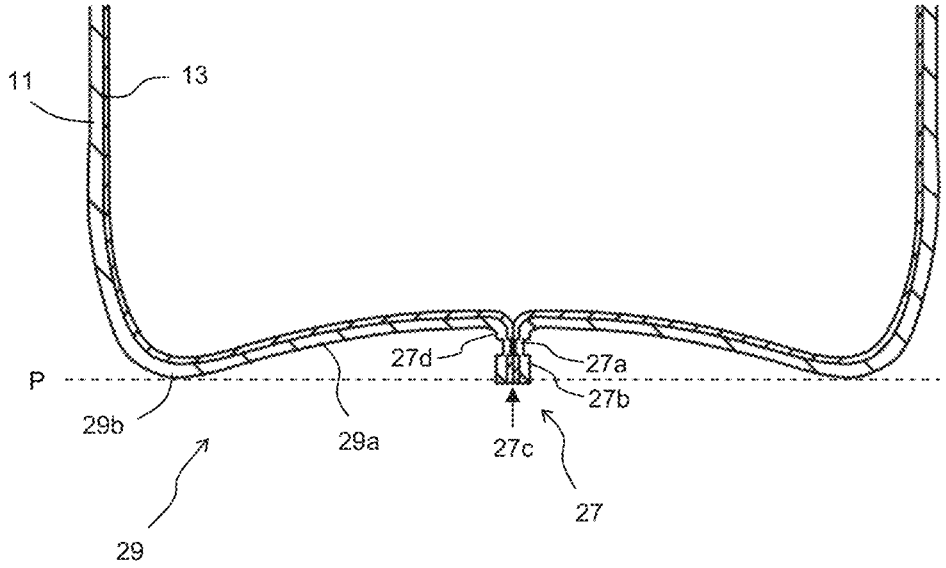
FIGS. 6A, 6B are enlarged views of a region including a bottom surface 29 in FIG. 3, where
Figure 6B:
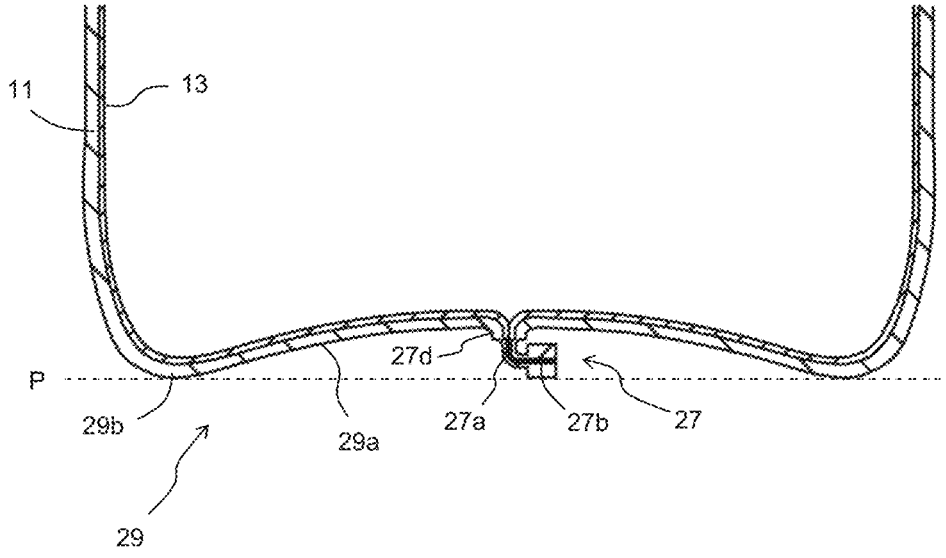

As illustrated in FIG. 1B, the storage portion 7 has a bottom surface 29 equipped with a central concave region 29*a* and a peripheral region 29*b* surrounding the former region, and the central concave region 29*a* is provided with a bottom seal protrusion 27 protruding from the bottom surface 29. As illustrated in FIGS. 6A and 6B, the bottom seal protrusion 27 is a sealing portion of a laminated parison in blow molding using a tubular laminated parison provided with the outer layer 11 and the inner layer 13. The bottom seal protrusion 27 is provided with, in order from the bottom surface 29 side, a base portion 27*d*, a thinner portion 27*a*, and a thicker portion 27*b* having a thickness greater than that of the thinner portion 27*a*.

Immediately after blow molding, as illustrated in FIG. 6A, the bottom seal protrusion 27 is in a state of standing approximately vertically to a plane P defined by the peripheral region 29*b*. In this state, however, when impact is applied to the container, the inner layers 13 in a welded portion 27*c* are prone to be separated from each other and the impact resistance is insufficient. In the present embodiment, the thinner portion 27*a* is softened by blowing hot air on the bottom seal protrusion 27 after blow molding to bend the bottom seal protrusion 27, as illustrated in FIG. 6B, in the thinner portion 27*a*. The impact resistance of the bottom seal protrusion 27 is thus improved simply by a simple procedure of bending the bottom seal protrusion 27. In addition, as illustrated in FIG. 6B, the bottom seal protrusion 27 does not protrude from the plane P defined by the peripheral region 29*b* in a state of being bent. This prevents, when the delaminated container 1 is stood, instability of the delaminated container 1 due to the bottom seal protrusion 27 sticking out of the plane P.

The base portion 27*d* is provided on the bottom surface 29 side closer than the thinner portion 27*a* and is an area thicker than the thinner portion 27*a*. Although the base portion 27*d* does not have to be provided, the impact resistance of the bottom seal protrusion 27 is further improved by providing the thinner portion 27*a* on the base portion 27*d*.

As illustrated in FIG. 1B, the concave region in the bottom surface 29 is provided across the entire bottom surface 29 in longitudinal directions of the bottom seal protrusion 27. That is, the central concave region 29*a* and the peripheral concave region 29*c* are connected. Such structure facilitates bending of the bottom seal protrusion 27.

The layer structure of the container body 3 is described below in further detail. The container body 3 is provided with the outer layer 11 and the inner layer 13. The outer layer 11 is formed with a larger thickness than the inner layer 13 so as to increase the restorability thereof.

Figure 7:
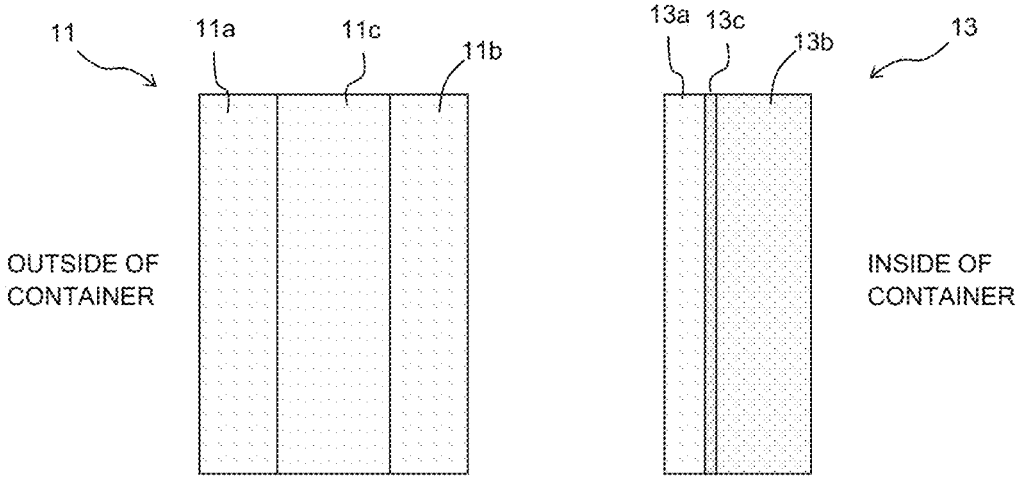
FIG. 7 is cross-sectional views illustrating layer structures of the outer layer 11 and the inner layer 13.

The outer layer 11 is formed of, for example, low-density polyethylene, linear low-density polyethylene, high-density polyethylene, polypropylene, ethylene-propylene copolymer, or a mixture thereof, or the like. The outer layer 11 consists of a single layer or multiple layers, and at least one of the innermost and outermost layers thereof contains a lubricant. If the outer layer 11 consists of a single layer, that single layer serves as both innermost and outermost layers. Accordingly, that layer only has to contain a lubricant. If the outer layer 11 consists of two layers, the layer closer to the inside of the container serves as the innermost layer, and the layer closer to the outside of the container serves as the outermost layer. Accordingly, at least one of these layers only has to contain a lubricant. If the outer layer 11 consists of three layers, the layer closest to the inside of the container serves as the innermost layer, and the layer closest to the outside of the container serves as the outermost layer. As shown in FIG. 7, the outer layer 11 preferably includes a repro layer 11*c* between an innermost layer 11*b* and an outermost layer 11*a*. As used herein, the term "repro layer" refers to a layer formed by recycling burrs generated when a container is molded. Further, if the outer layer 11 consists of multiple layers, both the innermost and outermost layers preferably contain a lubricant.

The lubricant may be any type of commercially available common lubricant. The lubricant may be one of a hydrocarbon-based lubricant, a fatty acid-based lubricant, an aliphatic amide-based lubricant, a metal soap-based lubricant, and a combination of two or more thereof. Examples of the hydrocarbon-based lubricant include liquid paraffin, paraffin wax, and synthesized polyethylene wax. Examples of the fatty acid-based lubricant include stearic acid and stearyl alcohol. Examples of the aliphatic amide-based lubricant include fatty amides, such as stearamide, oleic amide, and erucic acid amide, and alkylene fatty amides, such as methylene bis(stearamide) and ethylene bis(stearamide).

The innermost layer of the outer layer 11 is a layer that makes contact with the inner layer 13. By containing the lubricant in the innermost layer of the outer layer 11, it is possible to improve delamination properties between the outer layer 11 and the inner layer 13 and to improve deliverability of the contents of the delaminated container. Meanwhile, the outermost layer of the outer layer 11 is a layer that makes contact with a die during blow molding. By containing the lubricant in the outermost layer of the outer layer 11, it is possible to improve releasability.

One or both of the innermost layer and the outermost layer of the outer layer 11 may be formed with a random copolymer of propylene and another monomer. This enables improvement in shape restorability, transparency, and heat resistance of the outer shell 12.

The random copolymer has a content of a monomer other than propylene of less than 50 mol % and preferably from 5 to 35 mol %. Specifically, this content is, for example, 5, 10, 15, 20, 25, and 30 mol % or it may be in a range between any two values exemplified here. The monomer to be copolymerized with propylene may be one that improves impact resistance of the random copolymer compared with a homopolymer of polypropylene, and ethylene is particularly preferred. In the case of a random copolymer of propylene and ethylene, the ethylene content is preferably from 5 to 30 mol %. Specifically, it is, for example, 5, 10, 15, 20, 25, and 30 mol % or it may be in a range between any two values exemplified here. The random copolymer preferably has a weight average molecular weight from 100 thousands to 500 thousands, and even more preferably from 100 thousands to 300 thousands. Specifically, the weight average molecular weight is, for example, 100 thousands, 150 thousands, 200 thousands, 250 thousands, 300 thousands, 350 thousands, 400 thousands, 450 thousands, and 500 thousands or it may be in a range between any two values exemplified here.

The random copolymer has a tensile modulus of elasticity preferably from 400 to 1600 MPa and more preferably from 1000 to 1600 MPa. This is because the shape restorability is particularly good with a tensile modulus of elasticity in such range. Specifically, the tensile modulus of elasticity is, for example, 400, 500, 600, 700, 800, 900, 1000, 1100, 1200, 1300, 1400, 1500, and 1600 Mpa or it may be in a range between any two values exemplified here.

Since an excessively hard container impairs feeling of using the container, a mixture obtained by mixing a flexible material, such as linear low density polyethylene, with the random copolymer may be used. Note that, in order not to severely interfere with effective properties of the random copolymer, the material to be mixed with the random copolymer is preferably mixed to be less than 50 weight % based on the entire mixture. For example, a mixture obtained by mixing the random copolymer and linear low-density polyethylene at a weight ratio of 85:15 may be used.

As illustrated in FIG. 7, the inner layer 13 includes an EVOH layer 13*a* provided on a container outer surface side, an inner surface layer 13*b* provided on a container inner surface side of the EVOH layer 13*a*, and an adhesion layer 13*c* provided between the EVOH layer 13*a* and the inner surface layer 13*b*. By providing the EVOH layer 13*a*, it is possible to improve gas barrier properties and delamination properties from the outer layer 11.

The EVOH layer 13*a* is a layer containing an ethylene-vinyl alcohol copolymer (EVOH) resin and is obtained by hydrolysis of a copolymer of ethylene and vinyl acetate. The EVOH resin has an ethylene content, for example, from 25 to 50 mol %, and from the perspective of oxygen barrier properties, it is preferably 32 mol % or less. Although not particularly defined, the lower limit of the ethylene content is preferably 25 mol % or more because the flexibility of the EVOH layer 13*a* is prone to decrease when the ethylene content is less. The EVOH layer 13*a* preferably contains an oxygen absorbent. The content of an oxygen absorbent in the EVOH layer 13*a* further improves the oxygen barrier properties of the EVOH layer 13*a*.

The EVOH resin preferably has a melting point higher than the melting point of the resin contained in the outer layer 11. When the fresh air inlet 15 is formed in the outer layer 11 using a thermal perforator, the inlet can be prevented from reaching the inner layer 13 by the EVOH resin having a melting point higher than the melting point of the resin contained in the outer layer 11. From this perspective, a greater difference of (Melting Point of EVOH)−(Melting Point of the Resin from which the outer layer 11 is formed) is desired, and it is preferably 15° C. or more and particularly preferably 30° C. or more. The difference in melting points is, for example, from 5 to 50° C. Specifically, it is, for example, 5, 10, 15, 20, 25, 30, 35, 40, 45, and 50° C. or it may be in a range between any two values exemplified here.

The inner surface layer 13*b* is a layer to make contact with the contents of the delaminated container 1. It contains, for example, polyolefin, such as low density polyethylene, linear low density polyethylene, high density polyethylene, polypropylene, an ethylene-propylene copolymer, and a mixture thereof, and preferably low density polyethylene or linear low density polyethylene. The resin contained in the inner surface layer 13*b* preferably has a tensile modulus of elasticity from 50 to 300 MPa and more preferably from 70 to 200 MPa. This is because the inner surface layer 13*b* is particularly flexible when the tensile modulus of elasticity is in such range. Specifically, the tensile modulus of elasticity is, for example, specifically for example, 50, 100, 150, 200, 250, and 300 Mpa or it may be in a range between any two values exemplified here.

The adhesion layer 13*c* is a layer having a function of adhering the EVOH layer 13*a* to the inner surface layer 13*b*, and it is, for example, a product of adding acid modified polyolefin (e.g., maleic anhydride modified polyethylene) with carboxyl groups introduced therein to polyolefin described above or an ethylene-vinyl acetate copolymer (EVA). An example of the adhesion layer 13*c* is a mixture of acid modified polyethylene with low density polyethylene or linear low density polyethylene.

A description is then given to an example of a method of manufacturing the delaminated container 1 in the present embodiment.

Figures 9A, 9B, 9C, 9D:
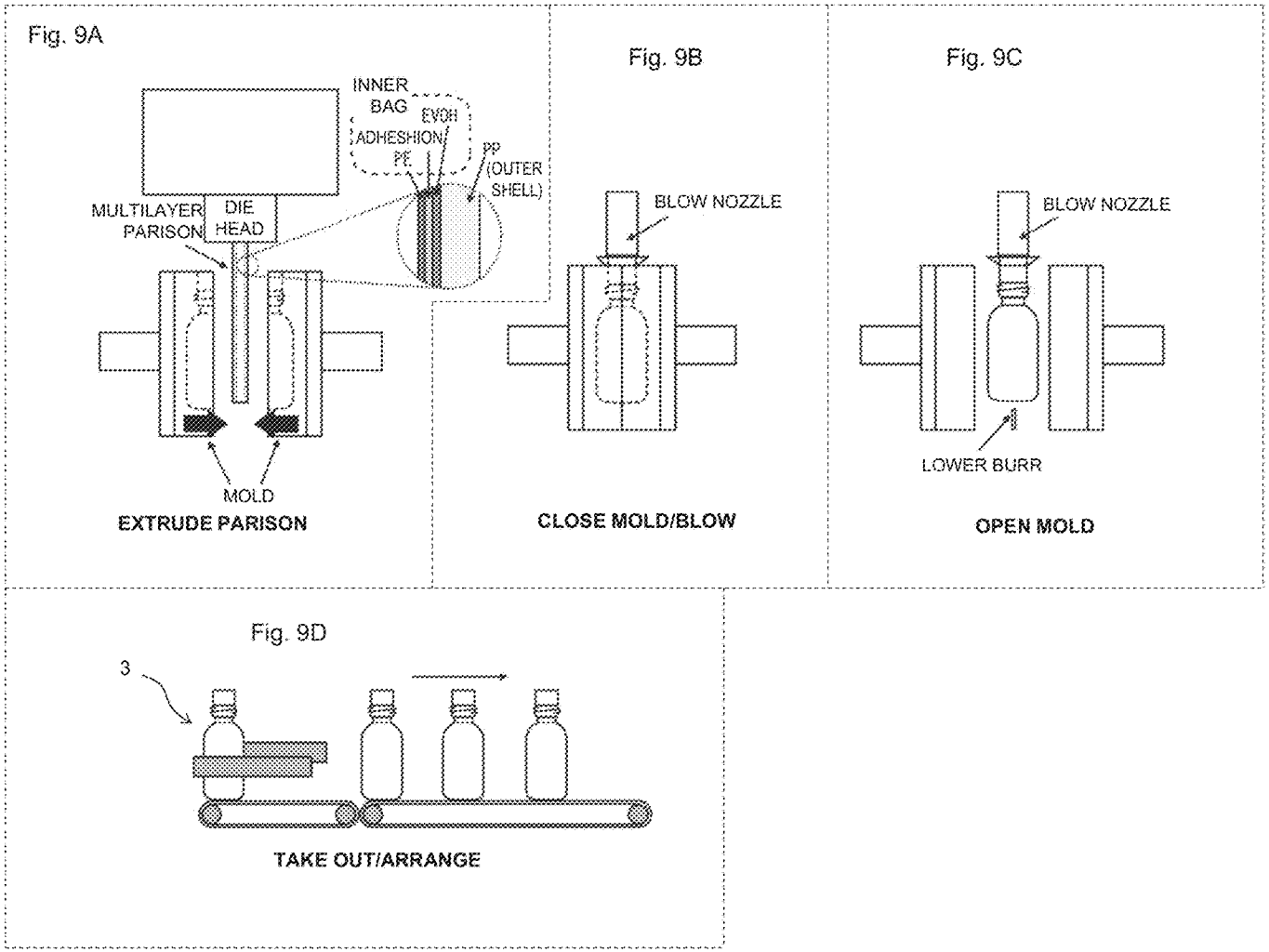
FIGS. 9A-9D illustrate a procedure of manufacturing the delaminated container 1 in FIGS. 1A-1C.

First, as illustrated in FIG. 9A, a laminated parison in a melted state with a laminated structure (e.g., a laminated structure of PE layer/adhesion layer/EVOH layer/PP layer/repro layer/PP layer in order from the container inner surface side) corresponding to the container body 3 to be manufactured is extruded. Then, the laminated parison in the melted state is set in a blow molding split die and the split die is closed.

Next, as illustrated in FIG. 9B, a blowing nozzle is inserted into an opening of the mouth 9 of the container body 3 to blow air into a cavity of the split die in the mold closing state.

Then, as illustrated in FIG. 9C, the split die is opened to take out a blow molded article. The split die has a cavity shape to form various shapes of the container body 3, such as the valve member mounting recess 7*a*, the air circulation groove 7*b*, and the bottom seal protrusion 27, in the blow molded article. The split die is provided with a pinch-off below the bottom seal protrusion 27. Lower burrs are thus formed in the area below the bottom seal protrusion 27 and they are removed. In the above procedure, the container body 3 having the outer shell 12 and the inner bag 14 is formed (container body formation).

Then, as illustrated in FIG. 9D, the container body 3 thus taken out are aligned.

Figure 10A:
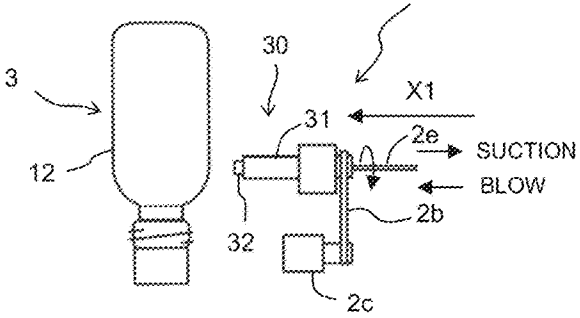
FIGS. 10A-10D illustrate the procedure of manufacturing the delaminated container 1 following FIG. 9D, and particularly illustrate fresh air inlet formation and inner layer preliminary delamination procedures.
Figure 10B:
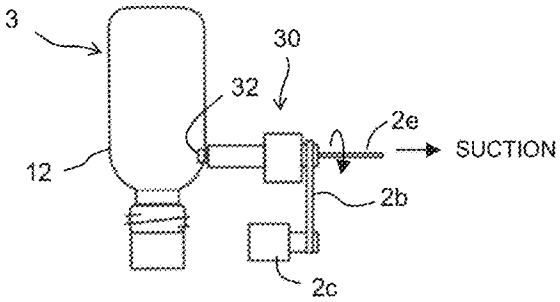
Figure 10C:
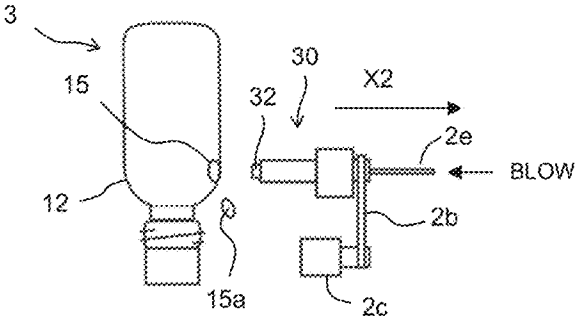

Then, as illustrated in FIGS. 10A-10C, a perforator 2 is used to form the fresh air inlet 15 in the outer shell 12 of the container body 3 (fresh air inlet formation). This procedure is described in detail below.

First, as illustrated in FIG. 10A, the container body 3 is set in a position close to the perforator 2. The perforator 2 is provided with a boring drill 30, having a body portion 31 and an end portion 32, and a motor 2*c* to rotationally drive the drill 30 through a transmission belt 2*b*. The perforator 2 is supported by a servo cylinder (not shown) to single-axis move the perforator 2 by rotation of a servo motor and is configured movably in an arrow X1 direction in FIG. 10A and in an arrow X2 direction in FIG. 10C. Such configuration enables rotation of the drill 30 while pressing the end portion 32 against the outer shell 12 of the container body 3. The control of the position and the moving speed of the perforator 2 by the servo motor enables reduction in tact time.

The drill 30 is provided with a hollow 33 extending from the body portion 31 to the end portion 32 (see, FIGS. 11A to 12B) and is coupled to a ventilation pipe 2*e* in communication with the hollow 33. The ventilation pipe 2*e* is coupled to an air intake and exhaust system, not shown. This enables air suction from inside the drill 30 and air blowing inside the drill 30.

Figure 11C:
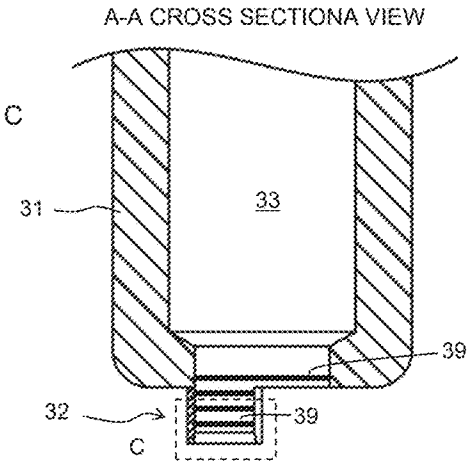
FIGS. 11A-11E illustrate configuration of a boring drill 30 used for formation of a fresh air inlet 15 in FIGS. 10A-10D, where
Figure 11A:
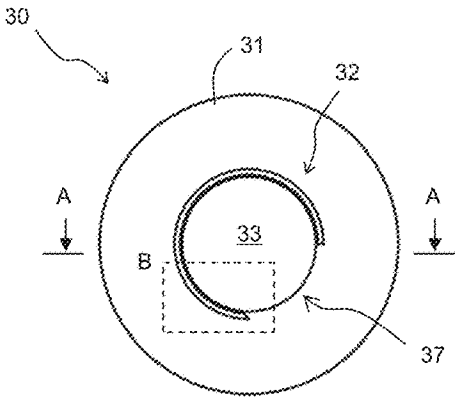
Figure 11B:
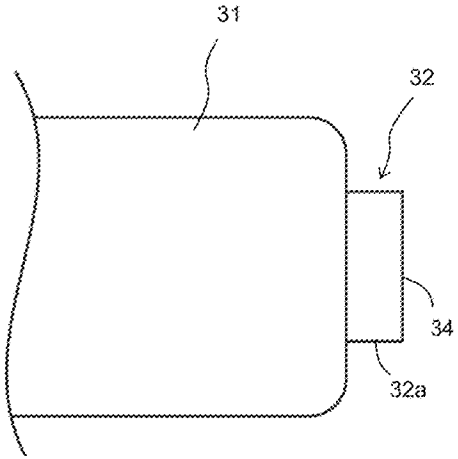
Figure 11E:
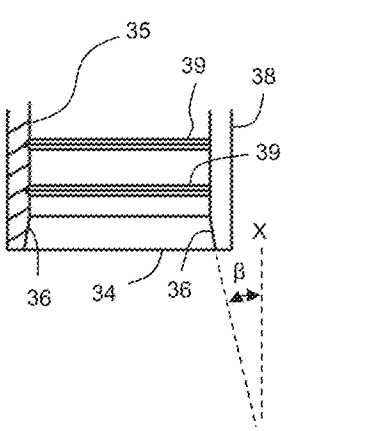
Figure 11D:
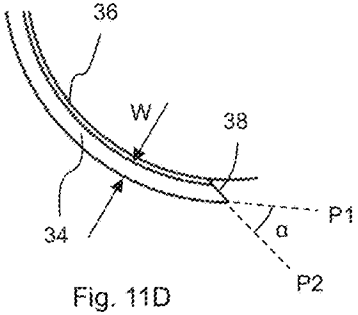
Figure 12A:
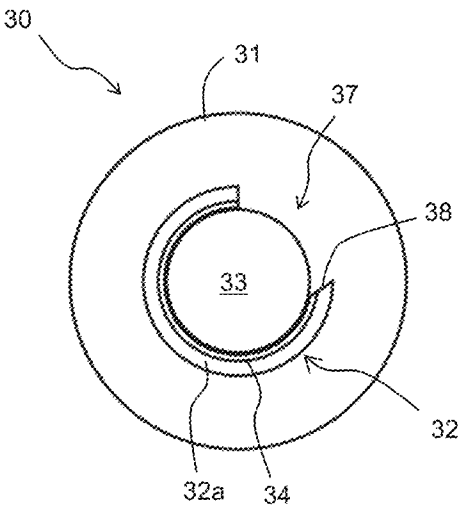
FIGS. 12A, 12B illustrate another configuration of the drill 30 used for formation of the fresh air inlet 15 in FIGS. 10A-10D, where
Figure 12B:
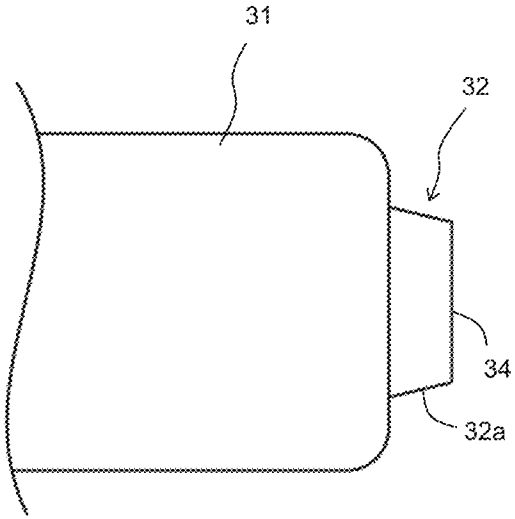

As illustrated in FIGS. 11A to 12B, the end portion 32 of the drill 30 is tubular having a C-shaped cross section. The end portion 32 is provided with a flat surface 34 and a notch 37, and the notch 37 has a side of a blade 38. The end portion 32 has a side 32*a* that may be, as illustrated in FIGS. 11A-11E, vertical to the flat surface 34 or may be, as illustrated in FIGS. 12A, 12B, a tapered surface inclined to the center as coming closer to the flat surface 34. In the latter case, the formed fresh air inlet 15 has an edge of a tapered surface widening towards outside and thus has an advantage of facilitating insertion of the valve member 4.

The flat surface 34 has a radial width W preferably from 0.1 to 0.2 mm and more preferably from 0.12 to 0.18 mm. A too small width W causes easy damage of the inner bag 14 during perforation. A too large width W causes difficulty in contacting the blade 38 with the outer shell 12, making it difficult to perform smooth perforation. The notch 37 is provided in a range preferably from 60 to 120 degrees and more preferably from 75 to 105 degrees. The notch being provided in a too large range causes easy damage of the inner bag 14 during perforation, whereas the notch being provided in a too small range causes difficulty in smooth perforation. The blade 38 has an inclined plane P2 at an angle $\alpha$ to a circumscribed surface P1 preferably from 30 to 65 degrees and more preferably from 40 to 55 degrees. A too small angle $\alpha$ causes easy damage of the inner bag 14 during perforation, whereas a too large angle $\alpha$ causes difficulty in smooth perforation.

The end portion 32 has an inner surface 35 provided with a tapered surface 36 widening towards the end. This facilitates movement of a cut piece 15*a* (see, FIG. 10C) produced by perforation to the inner surface 35 side, not remaining on the container body 3 side. The tapered surface 36 has an angle to the flat surface 34 preferably from 95 to 110 degrees and more preferably from 95 to 105 degrees. In other words, as illustrated in FIG. 11E, the tapered surface 36 has an angle $\beta$ in a direction X parallel to the rotation axis of the drill 30 preferably from 5 to 20 degrees and more preferably from 5 to 15 degrees. Further, the inner surface 35 is preferably provided with an approximately annular groove 39 in a concave or V shape with a depth from 0.05 to 0.1 mm and a width from 0.1 to 0.2 mm with a pitch from 0.2 to 1 mm in a direction vertical to the flat surface 34 (direction X parallel to the rotation axis of the drill 30), and in this case, the cut piece 15*a* more readily moves to the inner surface 35. The pitch of the groove 39 is more preferably from 0.3 to 0.7 mm. The inner surface 35 is preferably subjected to blasting for even easier movement of the cut piece 15*a* to the inner surface 35.

Then, as illustrated in FIG. 10B, while the drill 30 is rotated, the flat surface 34 is pressed against the outer shell 12. At this point, the flat surface 34 digs a little in the outer shell 12. As a result, the outer shell 12 partially enters the notch 37, and the blade 38 makes contact with the outer shell 12 to cut in the outer shell 12. When the flat surface 34 reaches a boundary between the outer shell 12 and the inner bag 14, the outer shell 12 is circularly hollowed to form the fresh air inlet 15 in a round hole shape. At this point, suction of air inside the drill 30 causes suction of the cut piece 15*a*, formed by hollowing the outer shell 12, in the hollow 33 of the drill 30.

When the flat surface 34 reaches the boundary between the outer shell 12 and the inner bag 14 and then the flat surface 34 is pressed against the inner bag 14, the inner bag 14 is delaminated from the outer shell 12 to be readily deformed towards inside the container body 3. The flat surface 34 thus does not dig in the inner bag 14 and the inner bag 14 does not make contact with the blade 38 to inhibit damaging of the inner bag 14.

In the present embodiment, the drill 30 is used without heating. This gives an advantage of not melting the edge of the fresh air inlet 15 to form the edge sharply. In order to inhibit influence due to heat generated by the friction between the boring drill 30 and the outer shell 12, the drill 30 is preferably form with a material having a high thermal conductivity (e.g., 35 W/(m·° C.) or higher at 20° C.). To facilitate the perforation more, the drill 30 may be heated. In this case, to keep the inner bag 14 from being melted by the heat of the drill 30, the resin contained in the outermost layer of the inner bag 14 preferably has a melting point higher than the melting point of the resin contained in the innermost layer of the outer shell 12.

Then, as illustrated in FIG. 10C, the perforator 2 is set back in the arrow X2 direction to blow air into the hollow 33 of the drill 30, thereby emitting the cut piece 15*a* from the edge of the drill 30.

In the above procedures, formation of the fresh air inlet 15 in the outer shell 12 is completed.

Figure 10D:
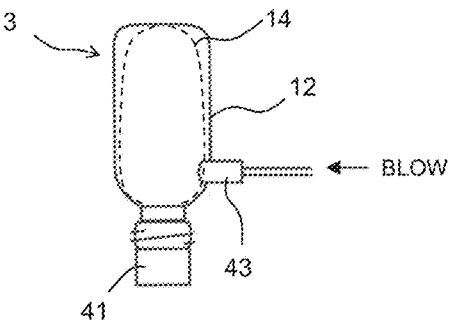

Then, as illustrated in FIG. 10D, a blower 43 is used to blow air between the outer shell 12 and the inner bag 14 through the fresh air inlet 15 for preliminary delamination of the inner bag 14 from the outer shell 12 (preliminary delamination). By blowing air in a defined amount while avoiding air leakage through the fresh air inlet 15, preliminary delamination of the inner bag 14 is readily controlled. The preliminary delamination may be applied in the entire storage portion 7 or may be in a partial region of the inner bag 14. It is, however, not possible to inspect the inner bag 14 for the presence of a pinhole in the region of not preliminarily delaminated. Accordingly, the inner bag 14 is preferably preliminarily delaminated from the outer shell 12 approximately in the entire storage portion 7. Air may be blown between the outer shell 12 and the inner bag 14 in another method. For example, air may be blown in an upper tubular portion 41 illustrated in FIG. 10D between the outer shell 12 and the inner bag 14 through an opening provided in the outer shell 12.

Figure 13A:
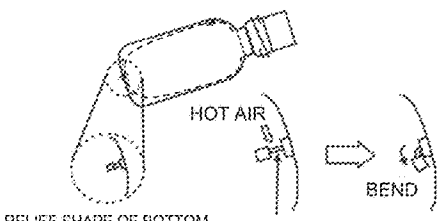
FIGS. 13A-13J illustrate the procedure of manufacturing the delaminated container 1 in FIGS. 1A-1C following FIG. 10D.

Then, as illustrated in FIG. 13A, the thinner portion 27*a* is softened by exposing the bottom seal protrusion 27 to hot air to bend the bottom seal protrusion 27.

Figure 13B:
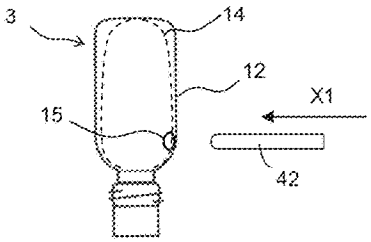
Figure 13C:
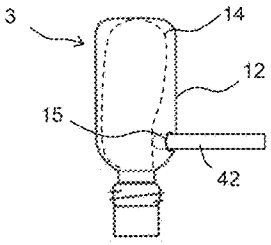

Then, as illustrated in FIGS. 13B-13C, an insertion tool 42 is moved as illustrated in an arrow X1 direction to insert the insertion tool 42 from the fresh air inlet 15. The inner bag 14 is then pressed inside the container body 3 by the insertion tool 42 to separate the inner bag 14 from the outer shell 12 (inner bag separation). This method allows large local separation of the inner bag 14 from the outer shell 12.

Figure 14C:
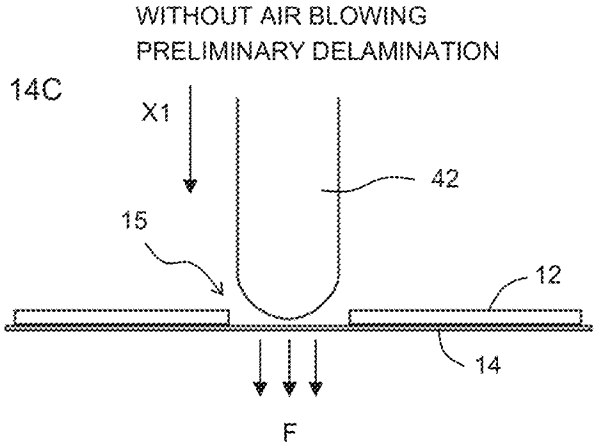
FIGS. 14A-14D are cross-sectional views illustrating details of the inner bag separation in FIGS. 13B-13C, where
Figure 14A:
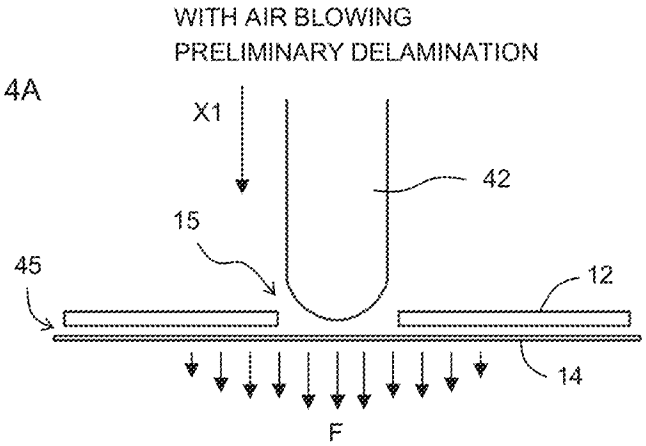
Figure 14D:
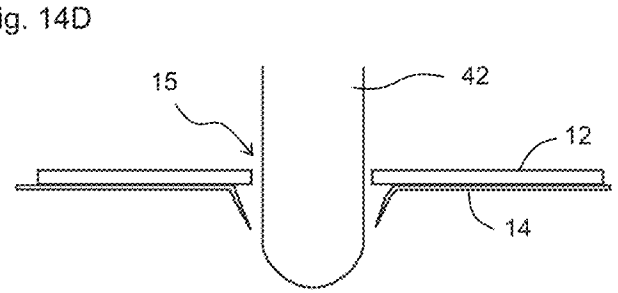
Figure 14B:
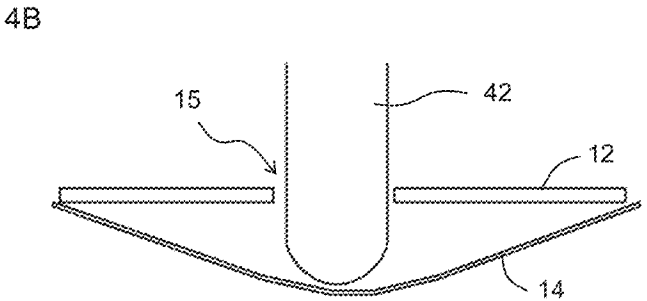

As illustrated in FIGS. 14A-14D, the insertion tool 42 is a rod shaped member in a shape with a round end and allowing insertion into the fresh air inlet 15 without pressing and expanding the fresh air inlet 15. That is, the insertion tool 42 preferably has a diameter approximately identical to the diameter of the fresh air inlet 15 or smaller than the diameter of the fresh air inlet 15. Insertion of the insertion tool 42 into the fresh air inlet 15 while moving the tool in the arrow X1 direction in FIG. 14A enables separation of, as illustrated in FIG. 14B, the inner bag 14 from the outer shell 12 near the fresh air inlet 15. The inner bag 14 has a small restoring force, and once the bag is in a state as illustrated in FIG. 14B, the bag does not return to the state of FIG. 14A even when the insertion tool 42 is pulled out. As illustrated in FIG. 14A, a gap 45 is formed between the outer shell 12 and the inner bag 14 by the preliminary delamination. When the insertion tool 42 is pressed on the inner bag 14, a load from the insertion tool 42 is spread over a wide range as illustrated by arrows F in FIG. 14A to be transmitted to the inner bag 14. In addition, the inner bag 14 is readily deformed towards the inside of the container body 3, and the inner bag 14 is thus not damaged. Meanwhile, as illustrated in FIG. 14C, when the insertion tool 42 is pressed on the inner bag 14 while the outer shell 12 and the inner bag 14 are closely contacted without performing the preliminary delamination in advance, the load F from the insertion tool 42 is applied to the inner bag 14 without being spread as illustrated in FIG. 14C and the inner bag 14 does not easily delaminate from the outer shell 12. As illustrated in FIG. 14D, the insertion tool 42 may thus penetrate or damage the inner bag 14. Accordingly, it is important to perform the preliminary delamination prior to the inner bag separation.

Figure 13D:
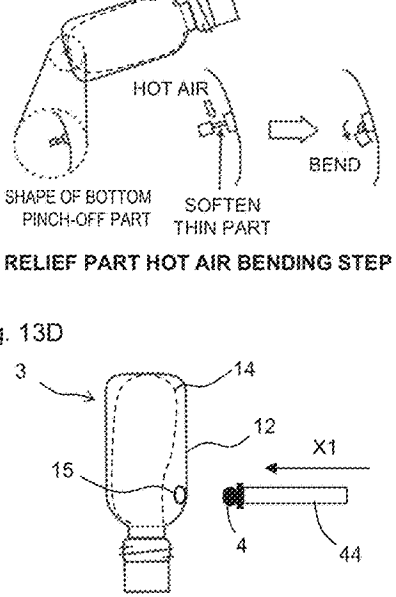
Figure 13E:
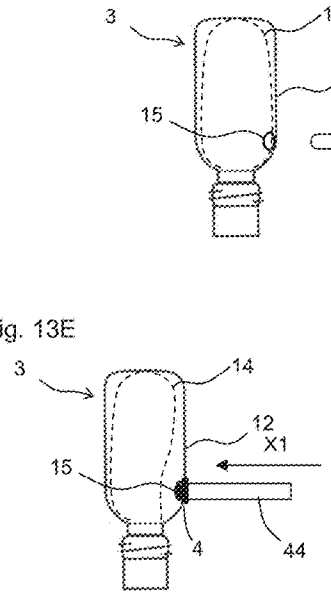
Figure 15C:
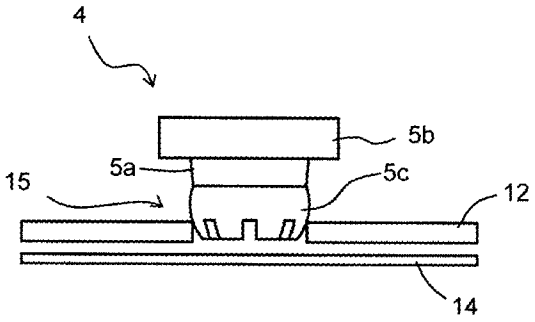
FIGS. 15A-15D are cross-sectional views (front views for the valve member 4) illustrating details of the valve member mounting in FIGS. 13D-13E, where
Figure 15D:
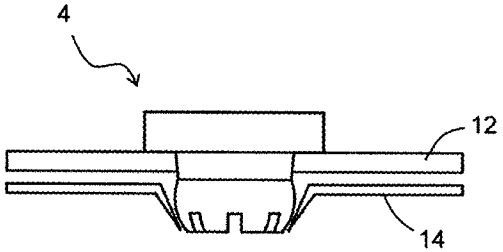
Figure 15A:
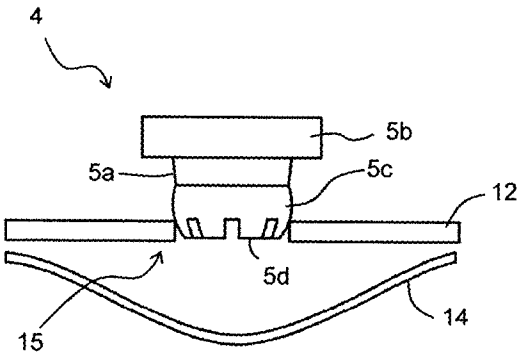
Figure 15B:
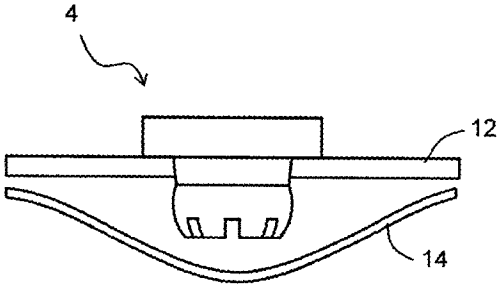

Then, as illustrated in FIGS. 13D-13E, a robot arm 44 is moved in the arrow X1 direction while adsorbing the valve member 4 and presses the valve member 4 into the fresh air inlet 15 to mount the valve member 4 to the outer shell 12 (valve member mounting). Specifically, as illustrated in FIGS. 15A-15B, the diametrically expanded portion 5*c* of the valve member 4 is pressed into the fresh air inlet 15 from outside the outer shell 12 for insertion to mount the valve member 4 to the outer shell 12. Since the diametrically expanded portion 5*c* has a diameter larger than that of the fresh air inlet 15, the diametrically expanded portion 5*c* passes through the fresh air inlet 15 while pressing and expanding the fresh air inlet 15. Then, immediately after passing through the fresh air inlet 15, the diametrically expanded portion 5*c* forcibly moves towards the inside of the container body 3. At this point, if the diametrically expanded portion 5*c* collides with the inner bag 14, the inner bag 14 has a risk of being damaged. In the present embodiment, the inner bag 14 is separated from the outer shell 12 in advance in the inner bag separation, and the diametrically expanded portion 5*c* scarcely or not at all makes contact with the inner bag 14 and the inner bag 14 is not damaged. Meanwhile, as illustrated in FIGS. 15C-15D, if the inner bag 14 is adjacent to the outer shell 12 without performing the inner bag separation, the diametrically expanded portion 5*c* may forcibly move towards the inside of the container body 3 immediately after passing through the fresh air inlet 15, and collides with the inner bag 14 to damage the inner bag 14. Accordingly, it is important to perform the inner bag separation prior to the valve member mounting.

Figure 13F:
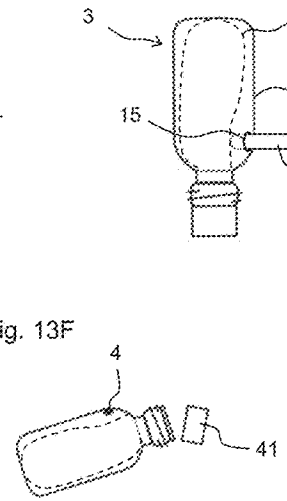

Then, as illustrated in FIG. 13F, an upper tubular portion 41 is cut.

Figure 13G:
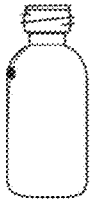

Then, as illustrated in FIG. 13G, the inner bag 14 is expanded by blowing air into the inner bag 14.

Figure 13H:
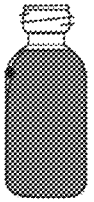

Then, as illustrated in FIG. 13H, the inner bag 14 is filled with the contents.

Figure 13I:
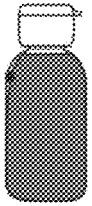

Then, as illustrated in FIG. 13I the cap 23 is mounted on the mouth 9.

Figure 13J:
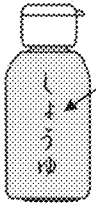

Then, as illustrated in FIG. 13J, the storage portion 7 is covered with a shrink film to complete the product.

The order of various procedures described here may be switched appropriately. For example, the hot air bending procedure may be before the fresh air inlet opening procedure or may be before the inner layer preliminary delamination procedure. The procedure of cutting the upper tubular portion 41 may be before inserting the valve member 4 into the fresh air inlet 15.

Then, working principle of the product thus manufactured in use is described.

As illustrated in FIGS. 16A through 16C, in a state where the product filled with the contents, a side of the outer shell 12 is squeezed for compression to deliver the contents. At the start of use, there is substantially no gap between the inner bag 14 and the outer shell 12, and thus the compressive force applied to the outer shell 12 directly becomes a compressive force to the inner bag 14 and the inner bag 14 is compressed to deliver the contents.

The cap 23 has a built-in check valve, not shown, so that it is capable of delivering the contents in the inner bag 14 but not capable of taking fresh air in the inner bag 14. Therefore, when the compressive force applied to the outer shell 12 is removed after delivery of the contents, the outer shell 12 attempts to be back in the original shape by the restoring force of itself but the inner bag 14 remains deflated and only the outer shell 12 expands. Then, as illustrated in FIG. 16D, inside the intermediate space 21 between the inner bag 14 and the outer shell 12 is in a reduced pressure state to introduce fresh air in the intermediate space 21 through the fresh air inlet 15 formed in the outer shell 12. While the pressure in the intermediate space 21 is reduced, the mobile part 6 is not pressed against the stopper 5*h* and thus does not interfere with introduction of fresh air. As illustrated in FIG. 8F, not to interfere with introduction of fresh air even when the mobile part 6 is located at the bottom of the cavity 5*g*, the cavity 5*g* has a bottom wall provided with the opening 5*e*.

Then, as illustrated in FIG. 16E, when the side of the outer shell 12 is again squeezed for compression, the mobile part 6 abuts on the stopper 5*h* to close the cavity 5*g*, causing an increase in the pressure in the intermediate space 21, and the compressive force applied to the outer shell 12 is transmitted to the inner bag 14 via the intermediate space 21 and the inner bag 14 is compressed by this force to deliver the contents.

Then, as illustrated in FIG. 16F, when the compressive force applied to the outer shell 12 is removed after delivery of the contents, the outer shell 12 is restored in the original shape by the restoring force of itself while fresh air is introduced in the intermediate space 21 from the fresh air inlet 15.

2. Second Embodiment

With reference to FIGS. 19A-19F, a delaminated container in a second embodiment of the present invention is described. The second embodiment is different only in the configuration of the valve member 4, and specifically mainly differs from the valve member 4 in the first embodiment in the shape of the tube 5 on the diametrically expanded portion 5*c* side and the shape of the stopper 5*h*. The following description is mainly given to the differences.

Figure 19A:
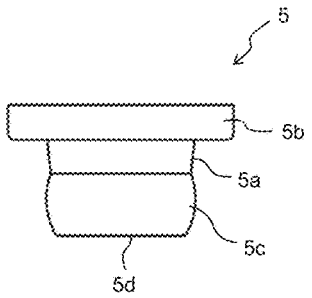
FIGS. 19A-19F illustrate a valve member 4 in a second embodiment of the present invention, where
Figure 19C:
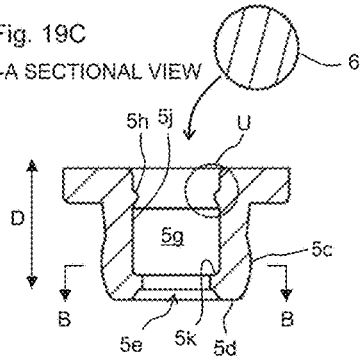
Figure 19E:
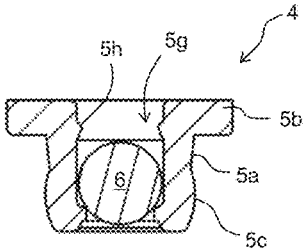
Figure 19B:
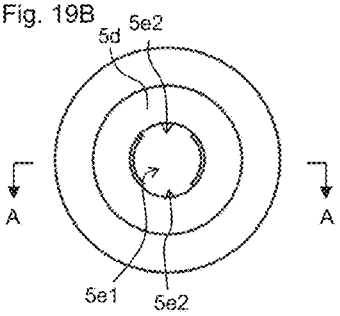
Figure 19D:
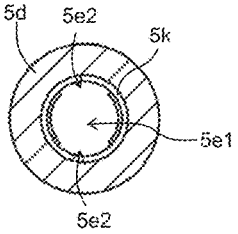

In the configuration of the first embodiment illustrated in FIGS. 8A-8G, the tube 5 has the flat surface 5*d* provided with the opening 5*e*. In the present embodiment, as illustrated in FIG. 19C, the cavity 5*g* has a bottom 5*k* raised, i.e., positioned on the external space S side to the flat surface 5*d* and the bottom 5*k* is provided with the opening 5*e*. The slits 5*e*2 are accordingly configured not to face the flat surface 5*d* and the sharp corner of the bottom 5*k* formed by the slits 5*e*2 does not hit the inner bag 14 to inhibit a damage in the inner bag 14 even better. In the present embodiment, as illustrated in FIG. 19D, each of the slits 5*e*2 extends over 90 degrees in the circumferential directions. The slits 5e2 thus shaped do not interfere with air flow even while the mobile part 6 abuts on the bottom 5k.

Figure 19F:
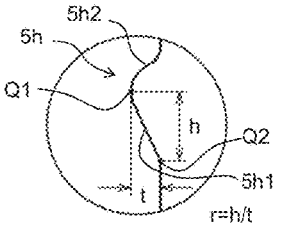

Meanwhile, as illustrated in FIG. 19F as an enlarged view of a U area in FIG. 19C, the stopper 5h in the present embodiment has a surface 5h1 on the cavity 5g side in a gently tapered shape. A ratio r=h/t of a height h to a width t is 1 or more, where the width t is from the side of the cavity 5g of a vertex Q1 most protruding in a cavity 5g direction and the height h is from a taper starting point Q2 to the vertex Q1. The ratio r is preferably from 1.0 to 3.0 and more preferably from 2.0 to 3.0. Such configuration inhibits turning up of the stopper 5h by removing a core pin from above to form the cavity 5g in the tube 5 during formation of the tube 5 by injection molding.

The stopper 5h also has a surface 5h2 on the external space S side (the opposite side from the cavity 5g) in a tapered shape, which facilitates insertion of the mobile part 6 into the cavity 5g. The surfaces 5h1 and 5h2 are respectively configured to be smoothly connected to the side of the cavity 5g, and in other words, configured to continuously change the radius of curvature of the curve forming the side of the cavity 5g.

In the present embodiment, the mobile part 6 has a diameter smaller than the diameter of the mobile part 6 in the first embodiment illustrated in FIGS. 8A-8G, and the stem 5a and the diametrically expanded portion 5c of the tube 5 are correspondingly thickened not to cause easy deformation of the tube 5 by pressing the valve member 4 into the container body 3. The stem 5a and the diametrically expanded portion 5c of the tube 5 preferably are from 0.2 to 1 time thicker than the diameter of the mobile part 6 and more preferably from 0.3 to 0.6 times.

3. Third Embodiment

With reference to FIGS. 20A-20H and FIG. 21, a delaminated container in a third embodiment of the present invention is described. The third embodiment is different only in the configuration of the valve member 4 from the above two embodiments, and specifically mainly differs in shapes of the parts related to the cavity 5g in the tube 5. The following description is mainly given to the differences.

In the first and second embodiments illustrated in FIGS. 8A-8G and 19A-19F, the mobile part 6 is disposed in the cavity 5g by pressing the mobile part 6 into the cavity 5g to pass across the stopper 5h from the external space S side. In the present embodiment, as illustrated in FIG. 20C, the mobile part 6 may be disposed in the cavity 5g by pressing the mobile part 6 into the cavity 5g from the intermediate space 21 side to pass across projections 5e3 described later. Although the configuration in the first and second embodiments has a risk of deforming the stopper 5h by pressing the mobile part 6 into the cavity 5g from the external space S side, such configuration in the present embodiment is capable of preventing deformation of the stopper 5h by pressing the mobile part 6 into the cavity 5g.

In the present embodiment, as illustrated in FIGS. 20B-20C, the tube 5 has a plurality of projections 5e3 on the surface 5j surrounding the cavity 5g. As illustrated in FIG. 20E, the projections 5e3 is provided to hold the mobile part 6 pressed into the cavity 5g and to prevent falling to the intermediate space 21 side. As illustrated in FIG. 20H as an enlarged view of a V area in FIG. 20C, the projections 5e3 has a surface 5e4 on the cavity 5g side in a gently tapered shape and has a ratio R=H/T of a height H to a width T of 1 or more, where the width T is from the side of the cavity 5g to a vertex Q3 most protruding in the cavity 5g direction and the height H is from a taper starting point Q4 to the vertex. The ratio R is preferably from 1.0 to 3.0 and more preferably from 2.0 to 3.0. Such configuration inhibits turning up of the projections 5e3 by removing a core pin to form the cavity 5g in the tube 5 from the intermediate space 21 side during formation of the tube 5 by injection molding described later.

Each projection 5e3 also has a surface 5e5 on the intermediate space 21 side (opposite side from the cavity 5g) in a tapered shape and facilitates insertion of the mobile part 6 into the cavity 5g. The surfaces 5e4 and 5e5 are respectively configured to be smoothly connected to the side of the cavity 5g, and in other words, configured to continuously change the radius of curvature of the curve forming the side of the cavity 5g. In the present embodiment, each projection 5e3 occupies approximately 40 degrees in the circumferential direction and the four projections 5e3 are provided at regular intervals (see, FIG. 20B).

Meanwhile, in the present embodiment, a partial area in the surface 5j surrounding the cavity 5g where the cavity 5g has a decreasing diameter towards the external space S side is formed as the stopper 5h. As illustrated in FIG. 20C, this area is a circular arc in a cross sectional view to be convex to the cavity 5g side and the tube 5 is thickened. As illustrated in FIG. 20G, even such a shape blocks air flow through the cavity 5g when the mobile part 6 abuts on the stopper 5h. The stopper 5h in such a shape makes contact closer to the center, compared with the above embodiment with the annular projection as the stopper 5h, between the mobile part 6 and the cavity 5g. In addition, the radius of curvature in the area making contact with the mobile part 6 in a cross sectional view of the stopper 5h is large, and thus the mobile part 6 does not come out to the external space S side even in a case of some dimensional error. The configuration also does not easily create a gap when the mobile part 6 abuts on the stopper 5h, and this is a shape advantageous to block air flow by securely abutting on the stopper 5h.

Figure 21:
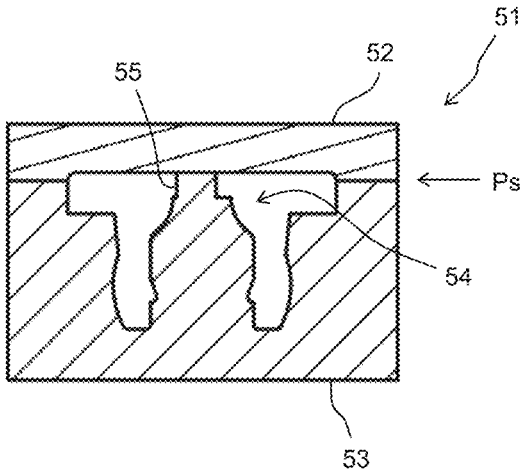
FIG. 21 is a cross-sectional view illustrating a die for forming the valve member 4 illustrated in FIGS. 20A-20H by injection molding.

Then, a description is given to a method of forming the tube 5 of the valve member 4 in the present embodiment with reference to FIG. 21. In the present embodiment, the tube 5 is formed by injection molding using, as illustrated in FIG. 21, a die 51 composed of an upper die 52 and a lower die 53. The tube 5 in the above embodiments is also formed by injection molding while it has a larger diameter of the cavity 5g relative to the opening 5e and is configured to remove the core pin to form the cavity 5g from the external space S side, i.e., from the locking portion 5b side. In contrast, in the present embodiment, the cavity 5g has a shape with a smaller inner diameter towards the external space S side and is configured to remove a core pin 54 to form the cavity 5g from the intermediate space 21 side, i.e., from the diametrically expanded portion 5c side. The core pin 54 is formed integrally with the lower die 53.

Such configuration of removing the core pin 54 from the intermediate space 21 side, i.e., from the diametrically expanded portion 5c side avoids turning up of the stopper 5h to open and close the valve as a main function of the valve member 4 for removal of the core pin 53. Together with the pressing of the mobile part 6 into the cavity 5g from the intermediate space 21 side, the configuration allows formation of the stopper 5h with high accuracy.

The die 51 illustrated in FIG. 21 has a parting surface Ps may be set in any position within a thickness of the locking portion 5b. The setting within the region allows prevention of damage in the container body 3 by burrs generated on the parting surface during injection molding when the valve member 4 is mounted. Although the upper die 52 in FIG. 21 is formed in an approximately planar shape, an area 55 of the smallest diameter at the end of the core pin 54 may be provided in the upper die 52.

In the present embodiment, a hole 5*m* communicating with the cavity 5*g* on the external space S side (see, FIG. 20C) is smaller than that in the above embodiments, being advantageous for prevention of entrance of a foreign substance from outside.

First Modification of Third Embodiment

Figure 22A:
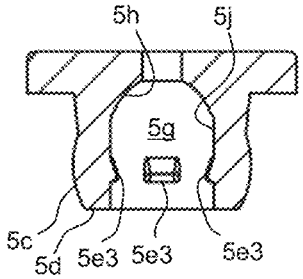
FIGS. 22A-22C illustrate a valve member 4 in a first modification of the third embodiment and are drawings corresponding to FIGS. 20C, 20G, and 20H.
Figure 22B:
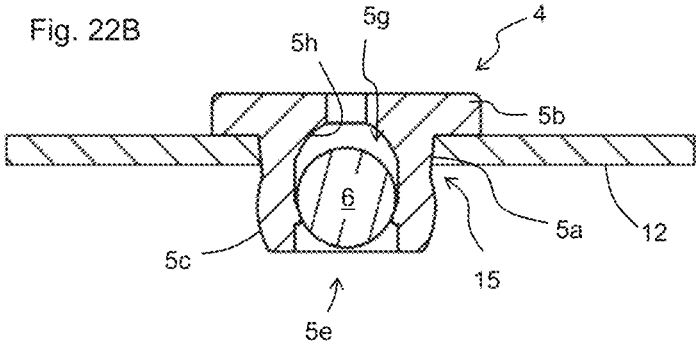
Figure 22C:
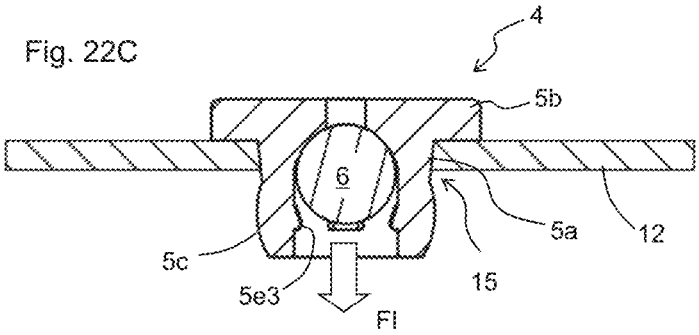

In the third embodiment, the stopper 5*h* formed by the surface 5*j* surrounding the cavity 5*g* is a circular arc to be convex to the cavity 5*g* side in a cross sectional view. In the first modification illustrated in FIGS. 22A-22C, the stopper 5*h* is a circular arc to be convex to the opposite sides from the cavity 5*g* in a cross sectional view. The stopper 5*h* has a shape in agreement with the shape of the outer surface of the spherical mobile part 6, causing a wider surface of the mobile part 6 abuts on the stopper 5*h* (see, FIG. 22C) to allow more effective block of air flow through the cavity 5*g*. The rest of the configuration is identical to that in the third embodiment, and the same actions and effects as those in the embodiment are obtained.

Second Modification of Third Embodiment

Figure 23:
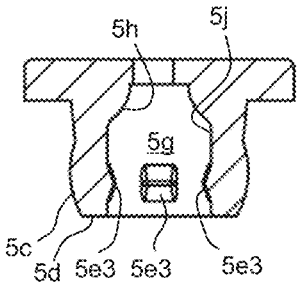
FIG. 23 illustrates a valve member 4 in a second modification of the third embodiment and is a drawing corresponding to FIG. 20C.

The second modification illustrated in FIG. 23 is different from the third embodiment in the projections 5*e*3 provided with a tapered surface having an identical inclination angle both to the intermediate space 21 side and the external space S side. The present modification has advantages that the same actions and effects as those in the embodiment are obtained and further the mobile part 6 is readily inserted into the cavity 5*g*.

REFERENCE SIGNS LIST

1: Delaminated Container, 3: Container Body, 4: Valve Member, 5: Tube, 6: Mobile Part, 7: Storage Portion, 9: Mouth, 11: Outer Layer, 12: Outer Shell, 13: Inner Layer, 14: Inner Bag, 15: Fresh Air Inlet, 21: Intermediate Space, 23: Cap, 27: Bottom Seal Protrusion, 42: Insertion Tool, 44: Robot Arm

The invention claimed is:

1. A delaminatable container, comprising:

a container body having an outer shell and an inner bag, the inner bag delaminating from the outer shell with a decrease in contents to be shrunk; and a valve member regulating entrance and exit of air between an external space of the container body and an intermediate space between the outer shell and the inner bag, wherein the container body includes a storage portion to store the contents and a mouth to discharge the contents from the storage portion, the outer shell includes a fresh air inlet communicating the intermediate space with the external space in the storage portion, the valve member includes a tube having a cavity provided to communicate the external space with the intermediate space and a mobile part movably stored in the cavity, the tube includes a stem disposed in the fresh air inlet and a locking portion provided on an external space side in the stem and preventing entrance of the tube to the intermediate space, the stem has a tapered shape towards an intermediate space side and has an outer circumferential surface closely contacting to an edge of the fresh air inlet, thereby mounting the tube to the container body, the tube has a stopper to lock the mobile part, in movement of the mobile part from the intermediate space side towards the external space side, on a surface surrounding the cavity, and the stopper is configured to block air communication through the cavity when the mobile part abuts on the stopper.

2. The container of claim 1, wherein the tube has an end providing a flat surface.

3. The container of claim 2, wherein the flat surface is provided with an opening in communication with the cavity, and the opening has radially extending slits.

4. The container of claim 1, wherein the tube has a diametrically expanded portion provided on the intermediate space side of the stem and preventing drawing of the tube from outside the container body.

5. The container of claim 4, wherein the diametrically expanded portion has a tapered shape towards the intermediate space side.

6. The container of claim 1, further comprising a cover covering, with the valve member mounted, surroundings of the valve member and the fresh air inlet to prevent introduction of fresh air into the intermediate space.

7. The container of claim 6, wherein the cover is a sealing member adhered to the surroundings of the valve member and the fresh air inlet.

8. The container of claim 6, wherein the cover is a cap mounted to the mouth of the container body.

9. The container of claim 1, wherein the valve member is configured to allow the mobile part to be inserted into the cavity from an opening on an intermediate space side of the cavity.

10. A delaminatable container, comprising:

a container body having an outer shell and an inner bag, the inner bag delaminating from the outer shell with a decrease in contents to be shrunk; and a valve member to regulate entrance and exit of air between an external space of the container body and an intermediate space between the outer shell and the inner bag, wherein the container body includes a storage portion to store the contents and a mouth to discharge the contents from the storage portion, the outer shell includes a fresh air inlet communicating the intermediate space with the external space in the storage portion, the valve member is mounted to the fresh air inlet, and the container further includes, with the valve member mounted thereto, a cover covering, from the outside of the container the valve member and the fresh air inlet to prevent introduction of fresh air into the intermediate space.

* * * * *